US012590709B2

(12) United States Patent
Widows

(10) Patent No.: US 12,590,709 B2
(45) Date of Patent: Mar. 31, 2026

(54) MULTI-TANK STORAGE TYPE GAS WATER HEATER

(71) Applicant: Stanley Ray Widows, Cicero, IN (US)

(72) Inventor: Stanley Ray Widows, Cicero, IN (US)

( * ) Notice: Subject to any disclaimer, the term of this patent is extended or adjusted under 35 U.S.C. 154(b) by 0 days.

(21) Appl. No.: 18/428,644

(22) Filed: Jan. 31, 2024

(65) Prior Publication Data

US 2025/0003604 A1 Jan. 2, 2025

Related U.S. Application Data

(63) Continuation-in-part of application No. 18/216,353, filed on Jun. 29, 2023.

(51) Int. Cl.

| | |
|---|---|
| ***F24D 17/00*** | (2022.01) |
| ***F24D 3/08*** | (2006.01) |
| ***F24H 8/00*** | (2022.01) |

(52) U.S. Cl.

CPC ..... *F24D 17/001* (2013.01); *F24D 3/082* (2013.01); *F24D 2200/04* (2013.01); *F24D 2200/18* (2013.01); *F24D 2220/06* (2013.01)

(58) Field of Classification Search

CPC ..... F24H 1/205; F24H 1/206; F24H 1/207; F24H 1/28; F24H 1/287; F24H 1/44; F24H 1/46; F24H 9/0026; F24H 9/0031; F24H 8/00; F28D 2020/0086; F24D 17/001; F24D 3/082

See application file for complete search history.

(56) References Cited

U.S. PATENT DOCUMENTS

| | | | | |
|---|---|---|---|---|
| 1,901,730 A * | 3/1933 | Brooks | F24H 1/28 122/165 |
| 3,315,645 A * | 4/1967 | Linnersten | F22B 1/16 122/33 |
| 4,222,350 A | 9/1980 | Pompei et al. | |
| 4,253,446 A | 3/1981 | Müller | |
| 4,403,572 A | 9/1983 | Gerstmann et al. | |
| 4,438,728 A * | 3/1984 | Fracaro | F24H 1/18 122/18.31 |
| 4,598,694 A | 7/1986 | Cromer | |

(Continued)

FOREIGN PATENT DOCUMENTS

EP 2489954 A2 8/2012

*Primary Examiner* — Steven S Anderson, II

(74) *Attorney, Agent, or Firm* — Bruce J. Bowman

(57) ABSTRACT

A storage type gas water heater has two or more tanks/areas providing a primary heated water storage area from which hot water is drawn, and one or more supplementary water storage areas utilizing hot combustion gas from the primary heated water storage area generating and supplying temperate water to previous supplementary water storage areas and/or the primary water storage area. An energy recovery chamber is situated between the primary heated water storage water area and the supplementary water storage area(s), with combustion gas vented therein. A hollow diffuser, defining a diffuser cavity, or one of various heat exchangers, is provided in the energy recovery chamber over the vented combustion gas. The diffuser cavity or heat exchanger receives temperate water from the supplemental water storage area and further heated by the vented combustion gas impinging the hollow diffuser or heat exchanger before being provided to the primary water storage area.

2 Claims, 13 Drawing Sheets

(56) References Cited

U.S. PATENT DOCUMENTS

| | | | | |
|---|---|---|---|---|
| 4,632,066 | A * | 12/1986 | Kideys | F24H 1/205 122/18.31 |
| 4,676,199 | A * | 6/1987 | Daugirda | F24H 8/006 122/18.31 |
| 5,027,749 | A * | 7/1991 | Cifaldi | F24H 1/205 122/18.31 |
| 5,355,841 | A * | 10/1994 | Moore, Jr. | F24H 9/1836 122/18.31 |
| 5,537,955 | A * | 7/1996 | Wu | F24H 1/124 122/18.1 |
| 6,553,947 | B2 | 4/2003 | Bradenbaugh | |
| 2001/0003274 | A1* | 6/2001 | Overbey, Jr. | F24H 9/1836 122/13.01 |
| 2002/0066419 | A1* | 6/2002 | Bradenbaugh | F24H 1/18 122/14.31 |
| 2004/0079749 | A1* | 4/2004 | Young | F24H 15/407 219/486 |
| 2004/0234255 | A1 | 11/2004 | Yui | |
| 2008/0085106 | A1* | 4/2008 | Jenson | F24H 1/165 392/490 |
| 2009/0133642 | A1* | 5/2009 | Asakura | F24H 8/00 165/47 |
| 2010/0290763 | A1* | 11/2010 | Boulay | F24H 15/164 219/494 |
| 2012/0060534 | A1* | 3/2012 | Zhang | F28F 13/08 62/238.7 |
| 2017/0167754 | A1* | 6/2017 | Lesage | F24H 9/0015 |
| 2018/0372374 | A1* | 12/2018 | Bailey | F24H 1/205 |
| 2019/0041092 | A1* | 2/2019 | Niu | F24H 1/205 |
| 2019/0368818 | A1* | 12/2019 | Wada | F24H 9/16 |
| 2022/0082296 | A1 | 3/2022 | Satyanarayana et al. | |

* cited by examiner

MULTI-TANK STORAGE TYPE GAS WATER HEATER

CROSS-REFERENCE TO RELATED APPLICATIONS

This U.S. non-provisional patent application is a continuation-in-part of co-pending U.S. non-provisional patent application Ser. No. 18/216,353 filed Jun. 29, 2023, titled "Muti-Tank Storage Type Gas Water Heater," the entire contents of which is specifically incorporated herein by reference.

FIELD OF THE INVENTION

The present invention relates to storage type gas water heaters and, more particularly, to multi-tank storage type gas water heaters.

BACKGROUND OF THE INVENTION

Typical or standard storage type gas water heaters include a storage tank configured to receive unheated water via a cold water inlet by a tube to the bottom of the tank and output heated water from a hot water outlet at the top of the tank. A radial flame gas burner is disposed at the bottom of the tank for heating the water contained in the bottom tank. A centrally located gas flue extends vertically through and out of the water tank discharged as hot combustion gas created by the burning gas as exhaust as 400 to 500 degrees. Typically, all of the water within the storage tank must be heated from a cold water from anywhere from 37 F to 67 F for most of the continental United States to a standard acceptable set temperature from a range of about 120° to 140° F. before a user may output heated water. The heated water is stored in the water tank until there is a demand. As a result, the heating process can often be time-consuming and inefficient, particularly when the storage tank is relatively large in volume. As such, most home gas water heaters will run an average two (2) to four (4) hours a day.

Additional heat may be transferred to the water in the water tank from hot combustion gas passing upward through the gas flue. Flue baffles may be employed in the gas flue for improving heat transfer from the combustion gas to the water in the water tank.

Further, as the storage tank outputs heated water, the storage tank can simultaneously or subsequently receive unheated water in order to meet the demand for heated water. When the unheated water flows into the storage tank, the overall temperature of water within the storage tank can be significantly reduced. Once the temperature of water within the storage tank is reduced due to the influx of unheated water, the water must be heated to achieve the desired set temperature, thereby requiring the need to expend additional energy to provide additional water at the desired temperature. Once achieving that temperature but not having any current demand the unit must continually cycle the burner to maintain the set temperature reducing efficiency of the gas water heater. If the unit has high density insulation and the unit is located inside a heated building or house the water temperature may be able to be maintained by standing pilot burner if sufficient size.

In view of the inefficiencies of typical storage type gas water heaters it would therefore be advantageous to have a storage type gas water heater that can heat volumes of water to a set temperature in increments. It would be further advantageous to have a storage type gas water heater with multiple tanks of water in different stages of being heated. It would be still further advantageous to have a storage type gas water heater with separate tanks that temperate water from combustion gas and supply the temperate water to a previously heated water tank. It would be even further advantageous to have a storage type gas water heater with a primary water storage tank for heating water to a set temperature with one or more supplementary water storage tanks that each provide temperate water from combustion gas of the primary water storage tank and supplies the temperate water to the primary water storage tank or a previous secondary water storage tank.

The present storage type gas water heater addresses the above and more.

SUMMARY OF THE INVENTION

A storage type gas water heater has a housing, a primary water storage tank within the housing and configured to accept temperate water from a supplementary or secondary water tank vertically disposed relative to the primary water storage tank that receives cold water inputted therein external to the housing via a cold water inlet, and heat the received temperate water to a preset temperature via a gas burner situated in a gas combustion chamber of the housing disposed vertically below the primary water storage tank for outputting the heated water from the housing via a hot water outlet, the storage type gas water heater having a diffuser chamber in the housing between the primary water storage tank and the supplementary water storage tank with a first gas flue portion extending vertically from the gas combustion chamber through the primary water storage tank and into the diffuser chamber for directing combustion gas from the gas combustion chamber into the diffuser chamber, the diffuser chamber having a diffuser situated vertically above the first gas flue portion for allowing the combustion gas to impinge on the diffuser to heat the diffuser, diffuser chamber, and bottom of the supplementary tank helping to temperate the cold water in the supplementary water storage tank, and a second gas flue portion extending vertically from the diffuser chamber vertically above the diffuser, through the supplementary water storage tank and out the housing.

The diffuser is preferably, but not necessarily, free standing in a fixed position in the diffuser chamber via a plurality of legs or other mechanical structure. In one form, the diffuser is comprised of a dome-shaped metal. In another form, the diffuser is comprised of a disc-shaped metal. In yet another form, the diffuser is comprised of a dish-shaped metal. The design and makeup of the diffuser would be specific to the exhaust flow rate desired to extract as much energy as possible before exiting through the flue.

In one form, the energy recovery chamber is hollow, thereby defining a diffuser cavity within the energy recovery chamber. All or some of the water from the supplementary water storage tank is diverted into the energy recovery chamber. The combustion gas impinging on the diffuser tempers (heats) the water in the diffuser cavity. Temperate water from the energy recovery chamber is then directed into the primary water storage tank. The hollow diffuser may be connected internally or externally.

The multi-tank storage type gas water heater, in another form, has an energy recovery chamber (ERC) in the housing between a primary water storage area and a supplementary water storage area with a first gas flue portion extending vertically from the gas combustion chamber through the primary water storage area and into the energy recovery chamber for directing combustion gas from the gas combustion chamber into the energy recovery chamber, the energy recovery chamber having a water heat exchanger situated vertically above the first gas flue portion for allowing the combustion gas to impinge on the water heat exchanger to heat the water heat exchanger and the water therein, the energy recovery chamber, and bottom of the supplementary water area helping to temperate the cold water in the supplementary water storage area, and a second gas flue portion extending vertically from the energy recovery chamber vertically above the water heat exchanger, through the supplementary water storage area and out the housing.

In one form, a diffuser is situated in the energy recovery chamber below the water heat exchanger. The energy recovery chamber is defined by a lower partition and an upper partition. The lower partition may form a top of the primary water storage area, while the upper partition may form a bottom of the supplementary water storage area.

The water heat exchanger may take various forms such as a multiple path heat exchanger, a ring heat exchanger, an internal coil heat exchanger having a coil that may be externally smooth or finned, a multiple path externally finned coil heat exchanger, a coil heat exchanger about the exterior of the energy recovery chamber, or a chambered water baffle heat exchanger. Given the size and design of the heat exchanger the exchanger itself may be serving as the baffle directing the exhaust gas path in and out of the Energy Recovery Chamber.

In all forms, the multi-tank storage type gas water heater also has a gas inlet connected to the gas burner, an ignitor for igniting the gas burner, and a thermostat for setting a water temperature of the water in the primary water storage tank and a high pressure relief valve to meet safety requirements for pressurized vessels. The multi-tank storage type gas water heater further has an air intake in communication with the gas combustion chamber for allowing ambient air to enter the gas combustion chamber.

The multi-tank storage type gas water heater may have a second supplementary or tertiary water storage tank situated vertically above the supplementary water storage tank that receives inputted cold water rather than the supplementary water storage tank and which provides temperate water to the supplementary water storage tank, with a second diffuser chamber between the supplementary water storage tank and the second supplementary water storage tank, with the second gas flue portion extending vertically into the second diffuser chamber for directing combustion gas from the diffuser chamber into the second diffuser chamber, the second chamber having a second situated vertically above the second gas flue portion for allowing the combustion gas to impinge on the second diffuser to heat the second diffuser and temperate the cold water in the second supplementary water storage tank, and a third gas flue portion extending vertically from the second diffuser chamber vertically above the second diffuser, through the second supplementary water storage tank and out the housing.

Depending on the amount of hot water required and desired level of efficiency, the number of tempering (supplementary) tanks, which would all have energy recovery/diffuser chambers, could be extended to however many were required so the example of 3 could be a starting point, not a maximum.

The multi-tank storage type gas water heater may have more than three water storage tanks, with a diffuser chamber and diffuser situated between each vertically successive water storage tank, and additional flue portions in like manner to the three-water tank storage form. Cold water would be inputted to the uppermost water storage tank with temperate water from an upper water storage tank being supplied to an immediately adjacent lower water storage tank. Hot water would be output from the primary water storage tank in a similar manner to the two and three water storage tank forms.

In the case of multiple supplementary water storage tanks and multiple diffuser chambers each with a diffuser therein, each diffuser in its diffuser chamber is hollow thereby defining a diffuser cavity within the hollow diffuser. Each diffuser cavity receives temperate water from the adjacent supplementary water storage tank either internally or externally. The combustion gas impinging on each diffuser tempers (heats) the water in its diffuser cavity. Temperate water from the diffuser cavity is then directed into the next supplementary water storage tank or the primary water storage tank.

In the case of multiple supplementary water storage tanks or areas and multiple energy recovery chambers each energy recovery chamber with one of the present water heat exchangers therein, with or without a diffuser, each water heat exchanger receives temperate water from the adjacent supplementary water storage area either internally or externally. The combustion gas impinging on each water heat exchanger, and/or associated diffuser, tempers (heats) the water in the water heat exchanger. Temperate water from the water heat exchanger is then directed into the next supplementary water storage area or the primary water storage area.

The present multi-tank storage type gas water heater provides multiple advantages over the prior art. The redirecting of hot exhaust gasses into the energy recovery chamber(s) allows for more of the available energy that is normally released as hot exhaust to be fully utilized when heating water—thereby providing for increased efficiency. Having a second water storage tank or area to pre-heat (temper) the water allows for faster recovery as the second or supplementary tank/area will not be trying to heat cold tap water like traditional water heaters.

More than one type of water heat exchanger may be used or combined and incorporated in the interior or exterior of the energy recovery chamber(s). This allows for the additional opportunity to use the availability of the hot exhaust gas energy in the water heating process.

The present multi-tank storage type gas water heater may have the same total capacity of traditional water heaters. However, utilizing two or more water storage tanks/areas will allow for the total BTU/burner capability to be used with a water tank of significantly less volume. This, combined with preheated or tempered water allows for faster recovery time and longer sustained supply of hot water with less total burner on time to complete the cycle of suppling needed hot water to final water temperature recovery and burner shut off.

Furthermore, when not in use, all standard water heaters maintain water at a full set temperature in the standby mode. With the present multi-tank storage type gas water heater the standby water volume is significantly less than in the traditional water heater so it will take less energy to maintain that water at the set full temperature. Moreover, while in the standby mode, the present multi-tank storage type gas water heater will contain to maintain the full set temperature of the primary tank/area but will also be continuing to raise the temperature of the supplementary tank(s)/area(s). This allows for the supplementary tank(s)/area(s) to continually raise the water temperature therein and recapture the energy that would normally be lost.

Moreover, when the present multi-tank storage type gas water heater has used all available hot water from the primary tank/area, the present multi-tank storage type gas water heater will, with a smaller volume primary tank/area, will complete the recovery cycle using up to 50% less time and up to 50% less gas.

Still further, if the gas exhaust temperature exiting the last supplementary water tank/area is reduced to under 200° F., a direct connection may be made between the exhaust and the interior of the home for normalizing the interior of the home for interior home comfort, since energy has already been expended to heat the water in the water heater. This will also eliminate the need to mix conditioned (heated or cooled) air from the interior of the structure to reduce the temperature of the exhaust pipe to a safe temperature.

Further aspects of the present invention will become apparent from consideration of the drawings and the following description of the invention. A person skilled in the art will realize that other forms of the invention are possible and that the details of the invention can be modified in a number of respects without departing from the inventive concept. The following drawings and description are to be regarded as illustrative in nature and not restrictive.

BRIEF DESCRIPTION OF THE DRAWINGS

The present invention and its features will be better understood by reference to the accompanying drawings, wherein.

Figure 1:
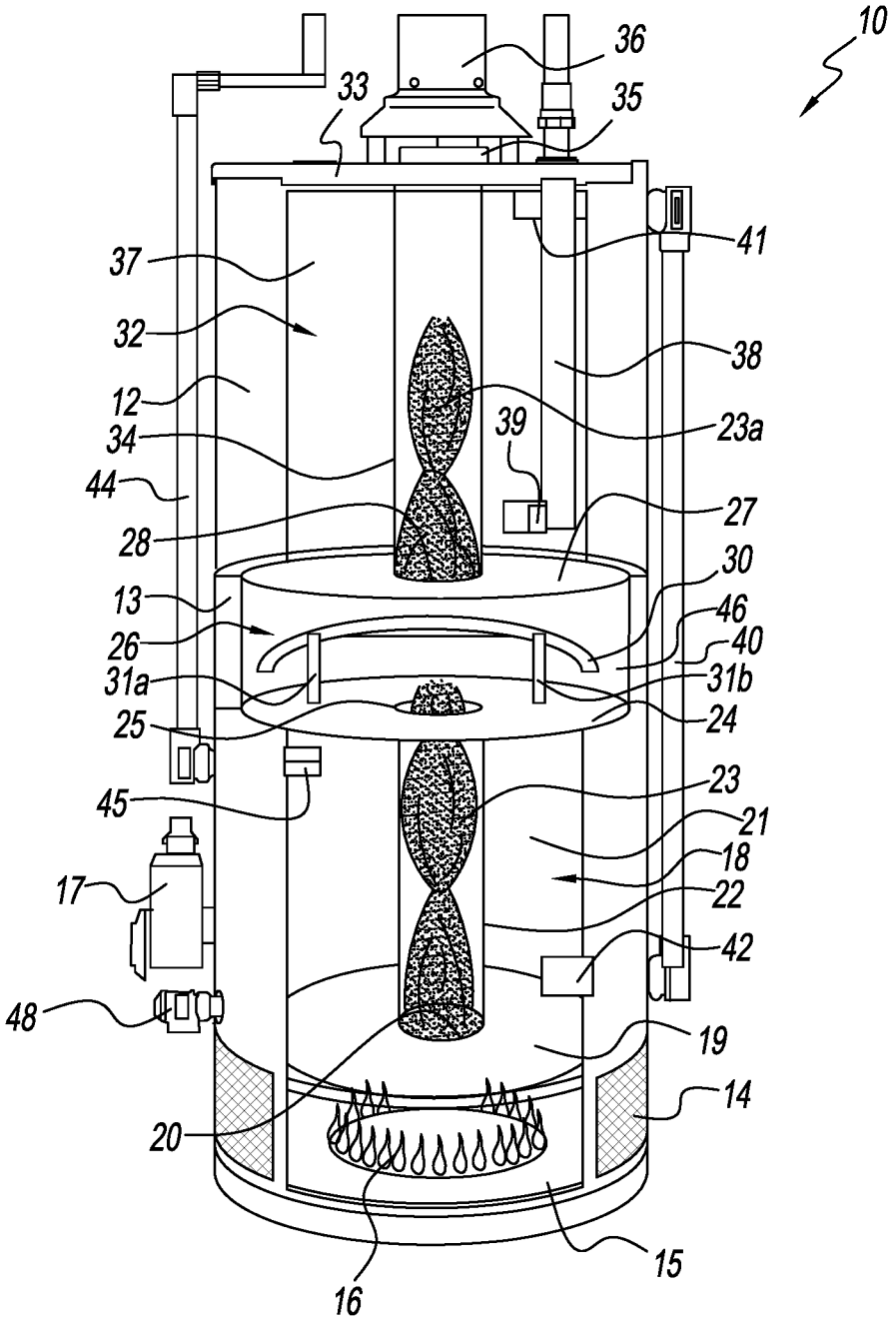
FIG. 1 is a partial sectional view of an exemplary embodiment of a multi-tank storage type gas water heater fashioned in accordance with the present principles.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

DETAILED DESCRIPTION OF THE INVENTION

Referring to FIG. 1, there is shown an exemplary embodiment of a multi-tank storage type gas water heater generally designated 10. The multi-tank storage type gas water heater 10 has a housing 12 in the general shape of a cylinder, however, the housing 12 may be shaped differently depending on desirability and/or function. The housing 12 is preferably, but not necessarily, made of metal and is hollow. Insulation 13 is provided along its inner cylindrical wall. The size of the housing 12 depends on its water storage capacity and thus may be made in various sizes.

The housing 12 encloses a lower chamber or compartment 15 fashioned as a gas combustion chamber with a radial gas burner 16 therein. Other styles of gas burners may be used and are contemplated. The radial gas burner 16 is connected to a gas valve and thermostat 17 for the water heater 10 and situated on the outside of the housing 12, the gas valve and thermostat 17 being connectable to a gas supply line (not shown). The housing 12 also includes one or more vents or air intakes 14 for allowing air into the combustion chamber 15. Vertically above the combustion chamber 15 is a water storage tank or chamber 18 divided from the combustion chamber 15 via a top wall or partition 19 that is also a bottom wall or partition 19 of the water storage tank 18. The water storage tank 18 may be considered a lower water storage tank, a primary water storage tank, or a first water storage tank with the nomenclature "first" being arbitrary. The primary water storage tank 18 also has a top wall or partition 24. The primary water storage tank 18 may be sized as desired to hold an amount of water. The wall/divider 19 is preferably, but not necessarily, made of metal, but may be made from another material that allows thermal transfer of heat generated from the gas burner 16 to water in the primary water storage tank.

The valve/thermostat 17 allows for setting a temperature for the water in the primary water storage tank and may be placed to help optimize burner activation once water falls below desired water temperatures. The primary water storage tank 18 is thus the hot water storage tank from which hot water is drawn. An outlet 45 is thus provided at a top section of the primary water storage tank 18 that is in communication with the primary water storage tank 18 and a hot water outlet tube 44 for dispensing/outputting hot water from the primary water storage tank 18 and thus the water heater 10. While the hot water outlet tube 44 is shown external to the housing 12, the hot water outlet tube may be internal to the housing 12 with an outlet thereof extending from the housing 12. The hot water tube/outlet 44 is connectable to a hot water supply conduit (not shown) to provide hot water to where it is needed.

The partition 19 has a hole or cutout 20 that is preferably, but not necessarily, situated in the center of the partition 19. A first flue portion or tube 22 extends from the hole 20 to a hole or cutout 25 of the partition 24 to allow hot combustion gas or exhaust 23 from the burning of gas (or other combustible fuel) from the gas burner 16. Situated above the primary water storage tank 18 is a diffuser chamber or hot exhaust gas recovery chamber 26. The top or partition 24 of the primary water storage tank 18 defines/is the bottom or partition of the diffuser chamber 26. The first flue portion 22 allows the combustion gas 23 to flow into the diffuser chamber 26. A diffuser or baffle 30 is situated in the diffuser chamber 26. The diffuser 30 is situated over the outlet of the first flue portion 22 such that the hot combustion gas 23 flows or impinges onto the underside of the diffuser 30 and is redirected to the top 27 of the diffuser chamber which is the bottom of the first water storage tempering tank diffuser chamber 26 to heat the top 27 of the diffuser chamber 26. The diffuser 30 is preferably, but not necessarily, made of metal such that the diffuser 30 is heated by the hot combustion gas 23, as well as radiating acquired heat. Other materials may be used. The diffuser 30 is shown as dome or bell shaped with an air gap about its sides. Other shapes may be used and are contemplated. The diffuser 30 is supported on/by legs or supports 31*a*, 31*b*, 31*c*, 31*d*. The diffuser chamber 26 is also defined by the upper/top wall or partition 27, which also forms/defines a bottom of a second or supplementary water storage tank 32, the nomenclature second being arbitrary. The partition 27 has a hole or cutout 28 that is preferably, but not necessarily, situated in the center of the partition 27. A second flue portion or tube 34 extends from the hole 28 to an outlet 35 at the top of the housing 12 to allow hot combustion gas 23*a* from the diffuser chamber 26 to be vented from the housing 12/water heater 10. A powered or unpowered vent hood 36 is provided over the flue portion outlet to allow the hot combustion gas/exhaust 23*a* to escape from the housing 12/water heater 10.

The supplementary water storage tank 32 has a top 33 that may be the top of the housing 12 such that the supplementary water storage tank 32 can hold a volume of water. A cold water inlet 39 connected to a cold water supply pipe extends into a lower section of the supplementary water storage tank 32 for supplying cold water to the supplementary water storage tank 32. The cold water in the supplementary water storage tank 32 is warmed or tempered by the hot combustion gas 23 in the diffuser chamber 26 through radiant heat of the diffuser 30 and the redirection of the hot combustion gas 23 to the bottom 27 of the supplementary water storage tank in order to create temperate water in the supplementary water storage tank 32. The diffuser chamber is open on both ends and is a metal ring with and a possible heat exchanger and then a diffuser, or whatever material, that defines the outside of the chamber while the top and bottom are the physical water tanks.

An outlet 41 is provided at a top section of the supplementary water storage tank 32 that is connected via piping to an outlet 42 situated at a lower section of the primary water storage tank 18 to provide temperate water from the supplementary water storage tank 32 to the primary water storage tank 18. The temperate water is mixed with the hot water of the primary water storage tank 18 and heated. While the temperate water outlet tube is shown external to the housing 12, the temperate water outlet tube may be internal to the housing 12. The water heater 10 also includes a pressure relief valve 48 extending from the housing 12 and in communication with the interior of the primary water storage tank 18 for relieving any excess water pressure within the primary water storage tank 18.

Figure 2:
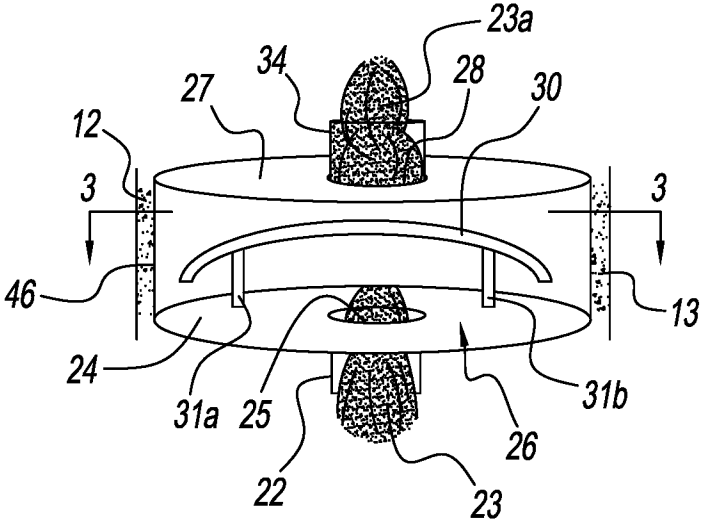
FIG. 2 is an enlarged sectional view of the diffuser chamber of the exemplary multi-tank storage type gas water heater of FIG. 1.

FIG. 2 depicts a perspective view of the diffuser/hot combustion gas energy recovery chamber 26 (diffuser chamber 26). The diffuser chamber 26 is essentially cylindrical, made from an appropriate metal or other similar material, and preferably, but not necessarily, follows the shape of the housing 12, thereby having a cylindrical wall 46. The diffuser chamber 26 may take other shapes as desired. Insulation 13 is preferably, but not necessarily, situated between the outer surface of the cylindrical wall 46 and the inner wall of the housing 12 as long as the exterior of the water heater skin, in or around the diffuser chambers are cool enough to meet safety standards for hot surfaces. The bottom 24 of the diffuser chamber is generally round having a generally round opening 25 preferably, but not necessarily situated in the center of the bottom 24. The first flue portion 22 extends to and/or into the opening 25. Combustion gas 23 is shown within the first flue portion 22 and entering the diffuser chamber 26. The top 27 of the diffuser chamber 26 is generally round having a generally round opening 28 preferably, but not necessarily situated in the center of the top 28. The second flue portion 34 extends from the opening 28. Combustion gas 23*a* is shown within the second flue portion 22 and exiting therefrom.

The diffuser 30 is made of metal or other material capable of being heated and able to radiate acquired heat. Cost and/or efficiency goals are contemplated. The diffuser 30 is generally dome-shaped and is supported by a plurality of legs 31*a*, 31*b*, 31*c* (not seen in FIG. 2), and 31*d* (not seen in FIG. 2). The first flue portion 22 is situated such that the hot combustion gas 23 from the gas combustion chamber enters the diffusion chamber 26 and impinges on the diffuser 30. This reroutes the hot exhaust (combustion) gas to heat the diffusion chamber 26 and the diffuser 30. In so doing, the heated diffusion chamber 26 and the diffuser 30 heats the top 27 of the diffuser chamber 26, which is also the bottom of the supplementary water storage tank 32 (see FIG. 1). This tempers the cold water in the supplementary water storage tank 32 to provide temperate water to the primary water storage tank 18.

Figure 3:
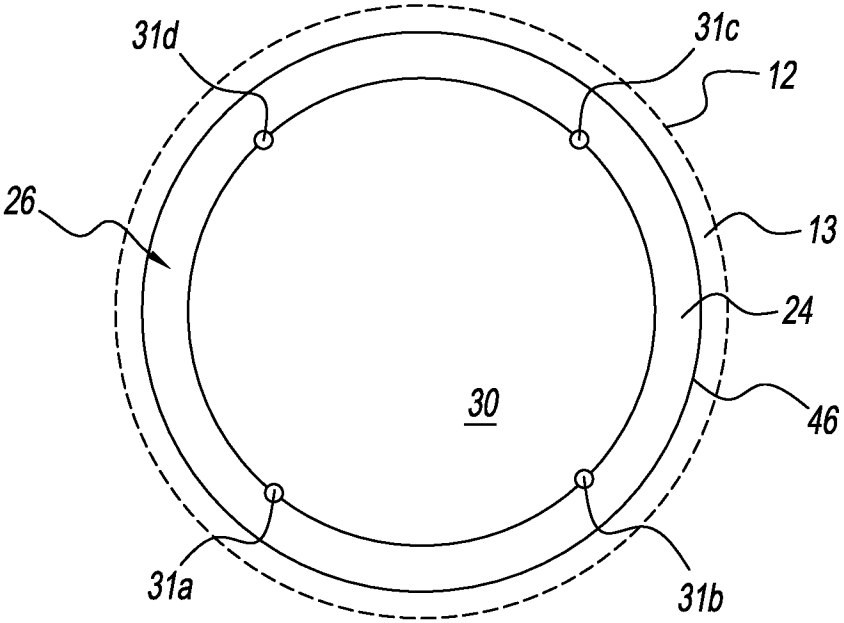
FIG. 3 is a top plan view of the diffuser chamber taken along line 3-3 of FIG. 2.

FIG. 3 depicts a top plan view of the diffuser 30 within the diffuser chamber 26 taken along line 3-3 of FIG. 2. The cylindrical wall 12 of the housing is shown in dashed line. Insulation 13 is between the inner surface of the housing 12 and the outer surface of the diffuser chamber wall 46. The diffuser 30 is shown supported on the four support legs 31*a*, 31*b*, 31*c*, 31*d*. The number, locations, and design of whatever is holding the diffuser in position will be dictated by what is the most cost effective way to achieve stability for the diffuser for the life of the water heater. The bottom 24 of the diffusion chamber 26 is shown. The space between the end side of the diffuser 30 and the outer wall 46 of the diffuser chamber 26 provides an air passage. The air passage spacing, and flue portion size, will be dictated by air volume needed to support proper combustion for gas burner BTU output. The spacing between the outer wall 46 of the diffuser chamber 26 and the wall of the housing 12 will be dictated by desired insulative value outside wall temperature safety.

Figure 4:
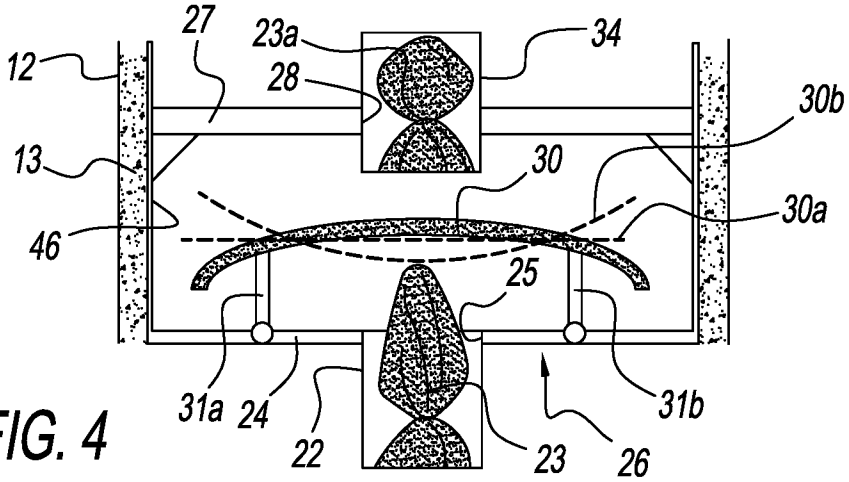
FIG. 4 is a sectional view of the diffuser chamber of FIG. 1 showing the inlet flue and the outlet flue illustrating several styles of diffusers.

FIG. 4 depicts a sectional side view of the diffuser chamber 26 within the housing illustrating several types of diffusers 30, 30*a*, 30*b* that may be used in the diffuser chamber 26. The diffuser 30 of the multi-tank storage type gas water heater 10 is shown supported on the legs 31*a*, 31*b* seen in FIG. 4. An alternate style of diffuser 30*a* is depicted in dashed line that is generally disc-shaped and flat. Another alternate style of diffuser 30*b* is depicted in dashed line that is generally dome-shaped. Both alternate diffusers 30*a*, 30*b* are metal or other material capable of being heated and able to radiate acquired heat. Other shapes may be used and are contemplated. Design and shape may be driven by an overall balance of being able to extract thermal energy while not impeding or restricting the combustion gas exhaust flow. Also, while the first diffusion chamber may have the dome or bell-shaped diffuser 30, subsequent diffuser chambers (as in FIG. 5) may need a less restrictive design.

Figure 5:
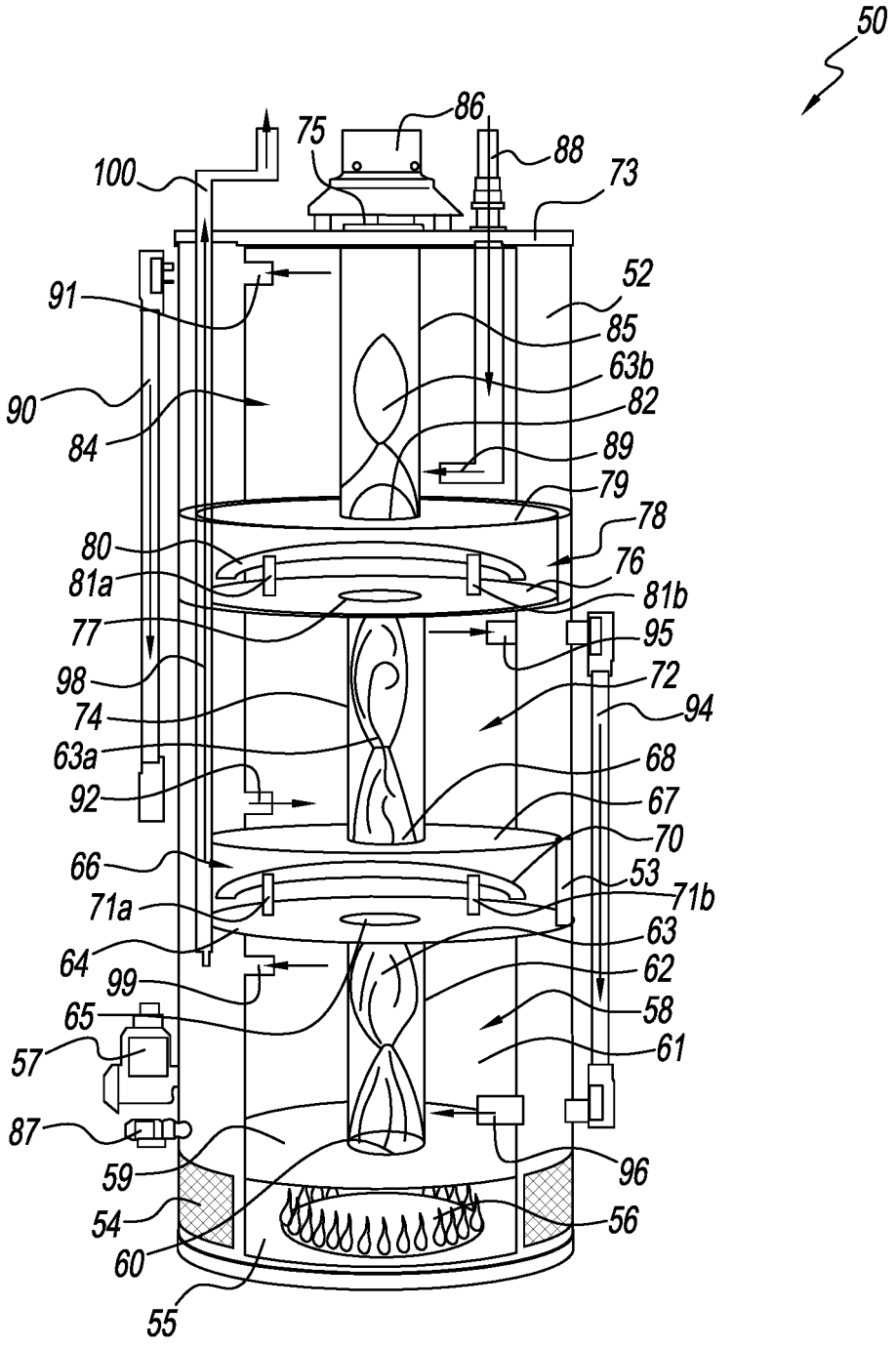
FIG. 5 is a sectional view of another exemplary embodiment of a multi-tank storage type gas water heater fashioned in accordance with the principles of the present invention.

Referring to FIG. 5, there is shown another exemplary embodiment of a multi-tank storage type gas water heater generally designated 50. The multi-tank storage type gas water heater 50 has a housing 52 in the general shape of a cylinder, however, the housing 52 may be shaped differently depending on desirability and/or function. The housing 52 is preferably, but not necessarily, made of metal and is hollow. Insulation 53 is provided along its inner cylindrical wall. The size of the housing 52 depends on its water storage capacity and thus may be made in various sizes.

The housing 52 encloses a lower chamber or compartment 55 fashioned as a gas combustion chamber with a radial gas burner 56 therein. Other styles of gas burners may be used and are contemplated. The radial gas burner 56 is connected to a gas valve and thermostat 57 for the water heater 50 and situated on the outside of the housing 52, the gas valve and thermostat 57 being connectable to a gas supply line (not shown). The housing 52 also includes one or more vents or air intakes 54 for allowing air into the combustion chamber 55. Vertically above the combustion chamber 55 is a water storage tank or chamber 58 divided from the combustion chamber 55 via a top wall or partition 59 that is also a bottom wall or partition 59 of the water storage tank 58. The water storage tank 58 may be considered a lower water storage tank, a primary water storage tank, or a first water storage tank with the nomenclature "first" being arbitrary. The primary water storage tank 58 also has a top wall or partition 64. The primary water storage tank 58 may be sized as desired to hold an amount of water. The wall/divider 59 is preferably, but not necessarily, made of metal, but may be made from another material that allows thermal transfer of heat generated from the gas burner 56 to water in the primary water storage tank.

The valve/thermostat 57 allows for setting a temperature for the water in the primary water storage tank. The primary water storage tank 58 is thus the hot water storage tank from which hot water is drawn. An outlet 99 is thus provided at a top section of the primary water storage tank 58 that is in communication with the primary water storage tank 58 and a hot water outlet tube 100 for dispensing/outputting hot water from the primary water storage tank 58 and thus the water heater 50. While the hot water outlet tube 100 is shown internal to the housing 15, the hot water outlet tube may be external to the housing 52 with an outlet thereof extending from the housing 52. The hot water tube/outlet is connectable to a hot water supply conduit (not shown) to provide hot water to where it is needed.

The partition 59 has a hole or cutout 60 that is preferably, but not necessarily, situated in the center of the partition 59. A first flue portion or tube 62 extends from the hole 60 to a hole or cutout 65 of the partition 64 to allow hot combustion gas or exhaust 63 from the burning of gas (or other combustible fuel) from the gas burner 56. Situated above the primary water storage tank 58 is a diffuser chamber or hot exhaust gas recovery chamber 66. The top or partition 64 of the primary water storage tank 58 defines/is the bottom or partition of the diffuser chamber 66. The first flue portion 62 allows the combustion gas 63 to flow into the diffuser chamber 66. A diffuser or baffle 70 is situated in the diffuser chamber 66. The diffuser 70 is situated over the outlet of the first flue portion 62 such that the hot combustion gas 63 flows or impinges onto the underside of the diffuser 70 and is redirected to the top 67 of the diffuser chamber 66 to heat the top 67 of the diffuser chamber 66. The diffuser 70 is preferably, but not necessarily, made of metal such that the diffuser 70 is heated by the hot combustion gas 63, as well as radiate acquired heat. Other materials may be used. The diffuser 70 is shown as dome or bell shaped with an air gap about its sides. Other shapes may be used and are contemplated (see FIG. 4). The diffuser 70 is supported on/by legs or supports 71*a*, 71*b*, 71*c*, 71*d*. The diffuser chamber 66 is also defined by the upper/top wall or partition 67, which also forms/defines a bottom of a second or supplementary water storage tank 72, the nomenclature second being arbitrary. The partition 67 has a hole or cutout 68 that is preferably, but not necessarily, situated in the center of the partition 67. A second flue portion or tube 74 extends from the hole 68 to a hole 77 in a top or partition 76 of the supplementary water storage tank 72. The partition 76 is also a bottom of a second diffuser or hot exhaust gas recovery chamber 78. The supplementary water storage tank 72 is such that the supplementary water storage tank 72 can hold a volume of water.

The second flue portion 74 allows the combustion gas 63*a* to flow from the first diffuser chamber 66 into the second diffuser chamber 78. A second diffuser or baffle 80 is situated in the second diffuser chamber 78. The second diffuser 80 is situated over the outlet of the second flue portion 74 such that the hot combustion gas 63*a* flows or impinges onto the underside of the second diffuser 80 and is redirected to a top 79 of the second diffuser chamber 78 to heat the top 79 of the second diffuser chamber 78. The second diffuser 80 is preferably, but not necessarily, made of metal such that the second diffuser 80 is heated by the hot combustion gas 63*a*, as well as radiating acquired heat. Other materials may be used. The second diffuser 80 is shown as dome or bell shaped with an air gap about its sides. Other shapes may be used and are contemplated (see FIG. 4). The second diffuser 80 is supported on/by second legs or supports 81*a*, 81*b*, 81*c*, 81*d*. The second diffuser chamber 78 is also defined by the upper/top wall or partition 79, which also forms/defines a bottom of a tertiary or second supplementary water storage tank 84, the nomenclature tertiary and second being arbitrary.

The second supplementary water storage tank 84 has a top 73 that may be the top of the housing 52 such that the second supplementary water storage tank 84 can hold a volume of water. A cold water inlet 89 connected to a cold water supply pipe 88 extends into a lower section of the second supplementary water storage tank 84 for supplying cold water to the second supplementary water storage tank 84. The cold water in the second supplementary water storage tank 84 is warmed or tempered by the hot combustion gas 23*a* in the second diffuser chamber 78 through radiant heat of the diffuser 70 and the redirection of the hot combustion gas 23*a* to the bottom 79 of the second supplementary water storage tank 84 in order to create temperate water in the second supplementary water storage tank 84.

The second diffuser chamber 78 is thus configured to temper the cold water in the second supplementary water storage tank 84 to create temperate water. An outlet 91 is provided at a top section of the second supplementary water storage tank 84 that is connected via piping to an outlet 92 at a lower section of the supplementary water storage tank 72 to provide the temperate water from the second supplementary water storage tank 84 to the supplementary water storage tank 72. The diffuser chamber 66 is thus configured to further temper the temperate water supplied from the second supplementary water storage tank 84 in the supplementary water storage tank 72 to create further temperate water.

An outlet 95 is provided at a top section of the supplementary water storage tank 72 that is connected via piping to an outlet 96 situated at a lower section of the primary water storage tank 58 to provide the further temperate water from the supplementary water storage tank 72 to the primary water storage tank 58. The further temperate water is mixed with the hot water of the primary water storage tank 58 and heated. While the temperate water outlet tube is shown external to the housing 52, the temperate water outlet tube may be internal to the housing 52. The water heater 50 also includes a pressure relief valve 87 extending from the housing 52 and in communication with the interior of the primary water storage tank 58 for relieving any excess water pressure within the primary water storage tank 58.

A third flue portion 85 extends from the hoe 82 of the top 79 of the second diffuser 78/bottom 79 of the second supplementary water storage tank 84 to an outlet 75 at the top of the housing 52 to allow hot combustion gas 63*b* from the second diffuser chamber 78 to be vented from the housing 52/water heater 50. A powered or unpowered vent hood 86 is provided over the flue portion outlet to allow the hot combustion gas/exhaust 63*b* to escape from the housing 52/water heater 50.

While not shown in the figures, and not necessary for the understanding of the present invention, a sacrificial anode rod may be needed to seal tank imperfections. Further, while not shown in the figures, and not necessary for the understanding of the present invention, a drain for sediment is provided for each water storage tank. Still further, while not shown in the figures, and not necessary for the understanding of the present invention, the diffuser chamber may be double walled to protect insulation, maintain a lower outer skin temperature, and retain and recover additional energy for the hot exhaust gasses.

Figure 6:
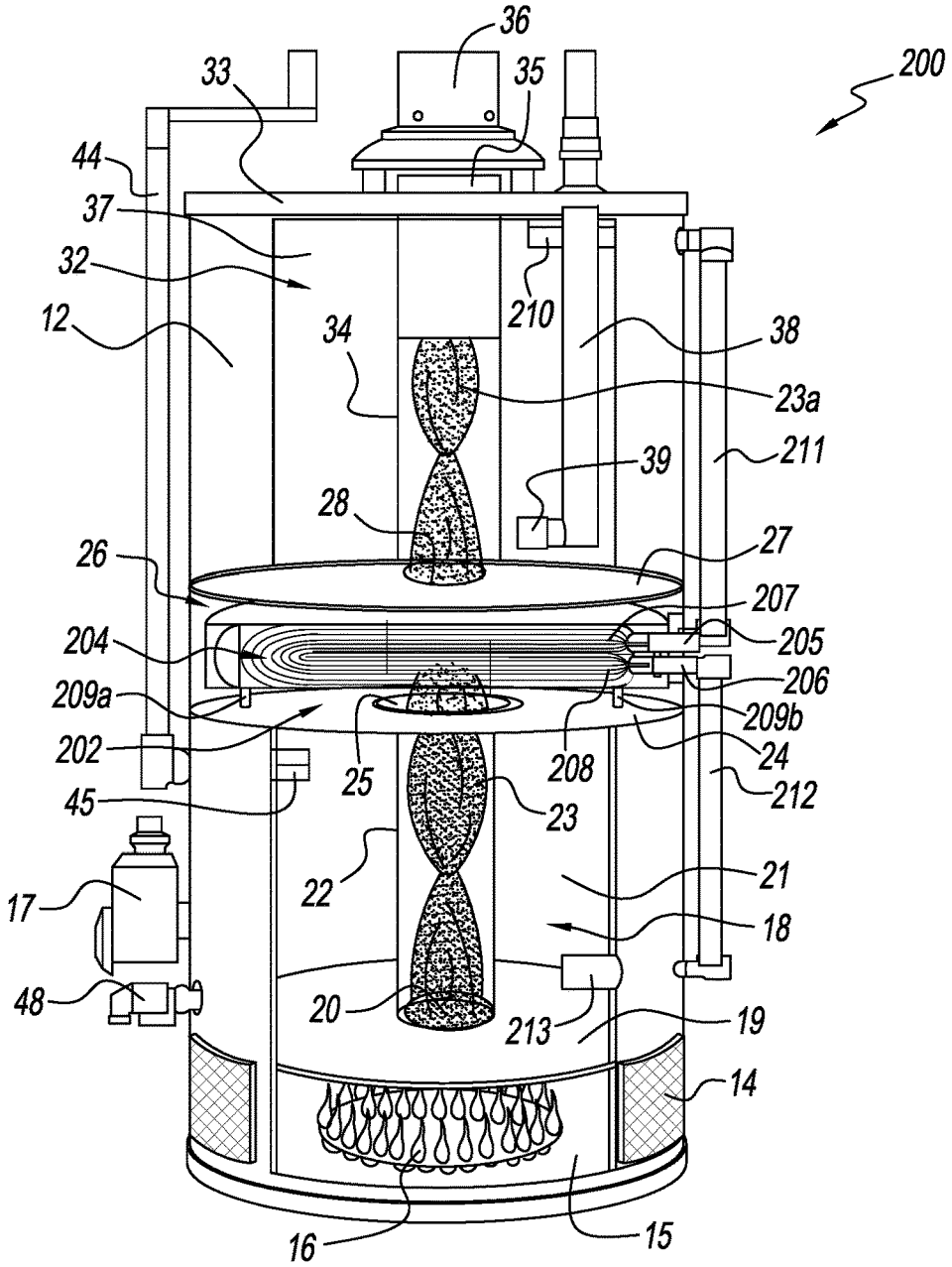
FIG. 6 is a sectional view of a further exemplary embodiment of a multi-tank storage type gas water heater fashioned in accordance with the principles of the present invention with an exhaust diffuser/heat exchanger in an energy recovery chamber, the exhaust diffuser/heat exchanger connected via an external connection.

Referring to FIG. 6, there is shown another exemplary embodiment of a multi-tank storage type gas water heater generally designated 200. Features and functions of the multi-tank storage type gas water heater 200 that are the same as the multi-tank storage type water heaters 10 (of FIG. 1) and 50 (of FIG. 5) have the same call-out number and will not be discussed with respect to the multi-tank storage type gas water heater 200. It should be appreciated that only the changes to the multi-tank storage type gas water heater 200 relative to the multi-tank storage type gas water heaters 10 and 50 will be described. However, it should be noted that hood 36 is situated over a draft diverter, while bottom plate 19 of the primary water storage tank/area 18 is a heat transfer surface. The multi-tank storage type gas water heater 200 has an energy recovery chamber 202 (or Carbon Reduction Chamber) situated between the primary water storage tank/area 18 and the supplementary water storage tank/area 32. The energy recovery chamber 202 is defined between the upper partition, divider, wall, panel, barrier or top 24 of the primary water storage tank/area 18 and the lower partition, divider, wall, panel, barrier or bottom 27 of the supplementary water storage tank/area 32. Further, while not shown, the first flue portion 22 may include one or more baffles, while the second flue portion 34 may also include one or more baffles.

Situated in the energy recovery chamber 202 is a water heat exchanger (heat exchanger) 204 designed to heat water therein via the exhaust gas 23 emanating from the first flue portion 22 and impinging thereon. The water heat exchanger 204 is shown suspended on legs or stands 209*a* and 209*b*. More legs or stands may be used, or none at all. The water heat exchanger 204 also serves as a diffuser by spreading the exhaust gas from the first flue portion 22 around the water heat exchanger 204 and within the energy recovery chamber 202 to exit from the energy recovery chamber 202 via the second flue portion 34.

The multi-tank storage type gas water heater 200 does not provide temperate water from the supplementary water storage tank 32 directly to the primary water storage tank 18 as did the multi-tank storage type gas water heaters 10 of FIG. 1 and 50 of FIG. 5. Rather, water from the supplementary water storage tank/area 32 is provided to the water heat exchanger 204. A water outlet 210 is provided in the supplementary water storage tank/area 32 that is coupled to a conduit 211 which is connected to a water inlet 205 of the water heat exchanger 204. The conduit 211 is external to the housing 12 of the multi-tank storage type gas water heater 200. The water heat exchanger 204 has a water outlet 206 that is coupled to a conduit 212 which is connected to a water inlet of the primary water storage tank/area 18. Thus, the water from the supplementary water storage tank/area 32 flows into the water heat exchanger 204, and from the water heat exchanger 204 to the primary water storage tank/area 18. This is an external water connection.

Figure 7:
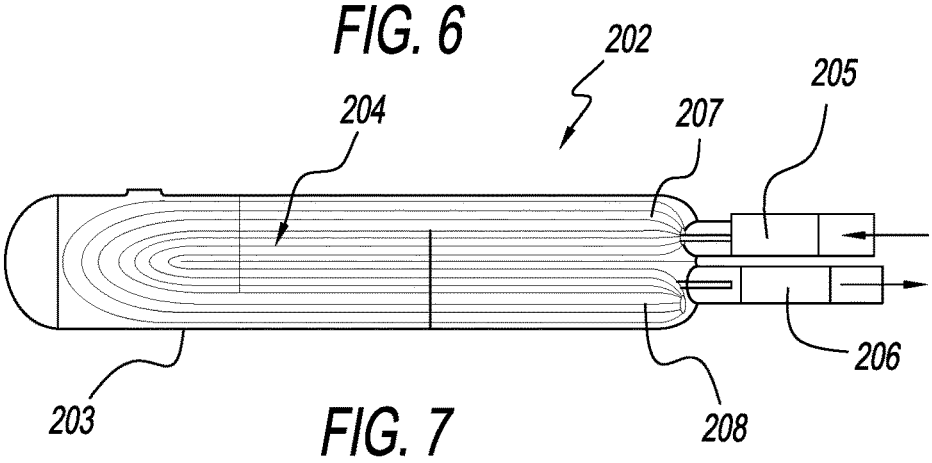
FIG. 7 is an enlarged view of the exhaust diffuser/heat exchanger of the energy recovery chamber of the multi-tank storage type gas water heater of FIG. 6.

The water heat exchanger 204 has one or more chambers each consisting of a single or multiple water flow paths. FIG. 7 depicts an enlarged view of the water heat exchanger 204. In the embodiment shown, the water heat exchanger 204 has two chambers each with multiple water flow paths. The multiple flow paths accept a variable flow rate allowing it to recover more energy from the impinging exhaust gas and flow of the exhaust gas within and through the energy recovery chamber 202. The water heat exchanger 204 may be made of various materials to maximize heat transfer from the exhaust gas 23 to the water in the water heat exchanger 204 and sized accordingly. While not shown, a diffuser may be provided beneath the water heat exchanger 204 or may be part of the heat exchanger design if desired.

Figure 8:
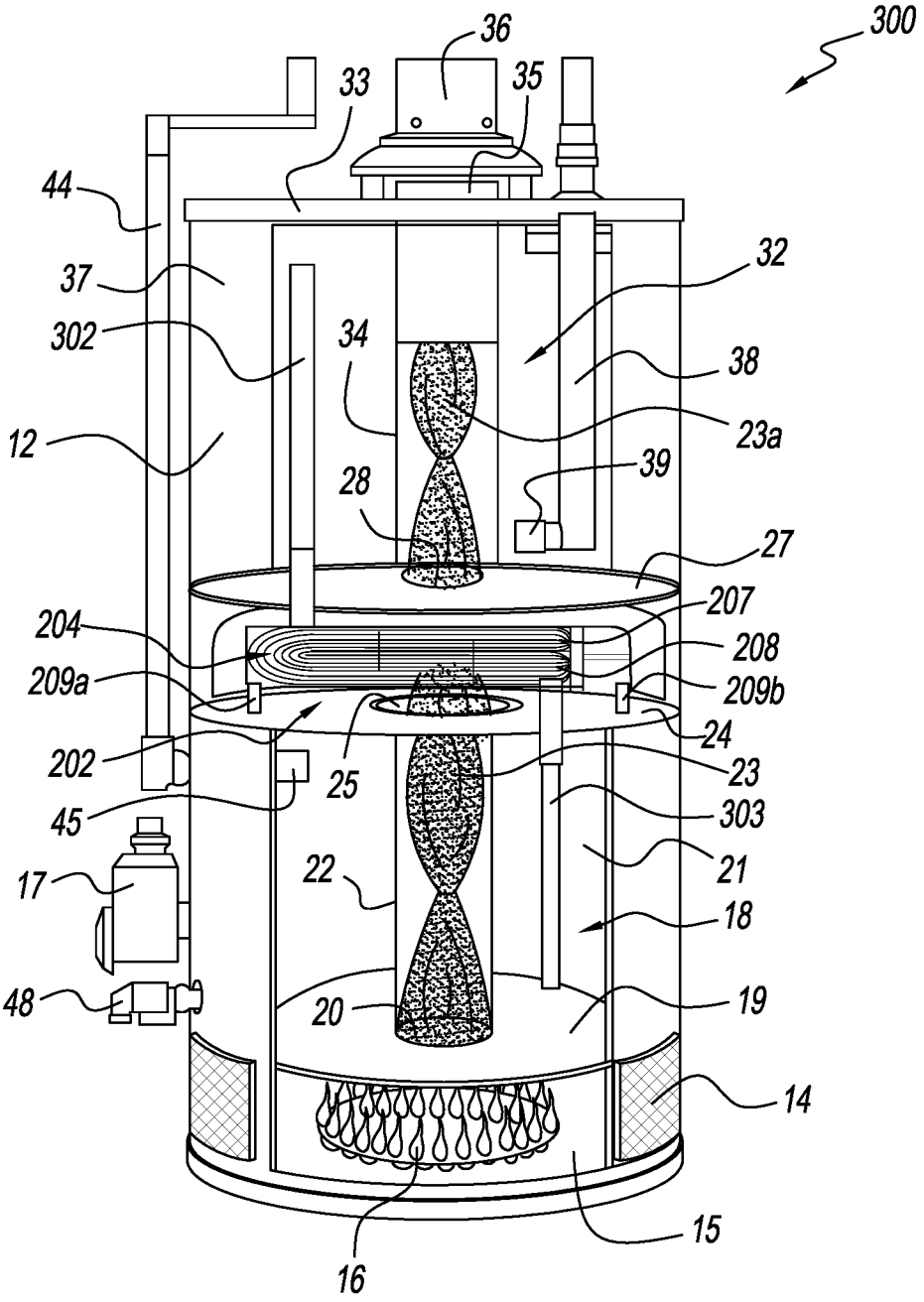
FIG. 8 is a sectional view of a further exemplary embodiment of a multi-tank storage type gas water heater fashioned in accordance with the principles of the present invention with the exhaust diffuser/heat exchanger of FIG. 7 in an energy recovery chamber, the exhaust diffuser/heat exchanger connected via an internal connection.

FIG. 8 depicts another exemplary embodiment of a multi-tank storage type gas water heater generally designated 300. Features and functions of the multi-tank storage type gas water heater 300 that are the same as the multi-tank storage type water heater 200 (of FIG. 6) have the same call-out number and will not be discussed with respect to the multi-tank storage type gas water heater 300. It should be appreciated that only the changes to the multi-tank storage type gas water heater 300 relative to the multi-tank storage type gas water heater 200 will be described. The multi-tank storage type gas water heater 300 is the same as the multi-tank storage type gas water heater 200 except the multi-tank storage type gas water heater 300 has an internal water connection between the supplementary water storage tank/area 32 and the water heat exchanger 204, and between the water heat exchanger 204 and the supplementary water storage tank/area 18. Particularly, a water inlet conduit 302 is provided in the supplementary water storage tank/area 32 that is coupled to the water heat exchanger 202 for supplying water from the supplementary water storage tank/area 18 to the water heat exchanger 204. A water outlet conduit 303 is connected from the water heat exchanger 204 to within the primary water storage tank/area 18 for providing water heated in the water heat exchanger 204 to the primary water storage tank/area 18. This is an internal water connection. While not shown, a diffuser may be provided beneath the water heat exchanger 204 or may be incorporated in the heat exchanger design if desired.

Figure 9:
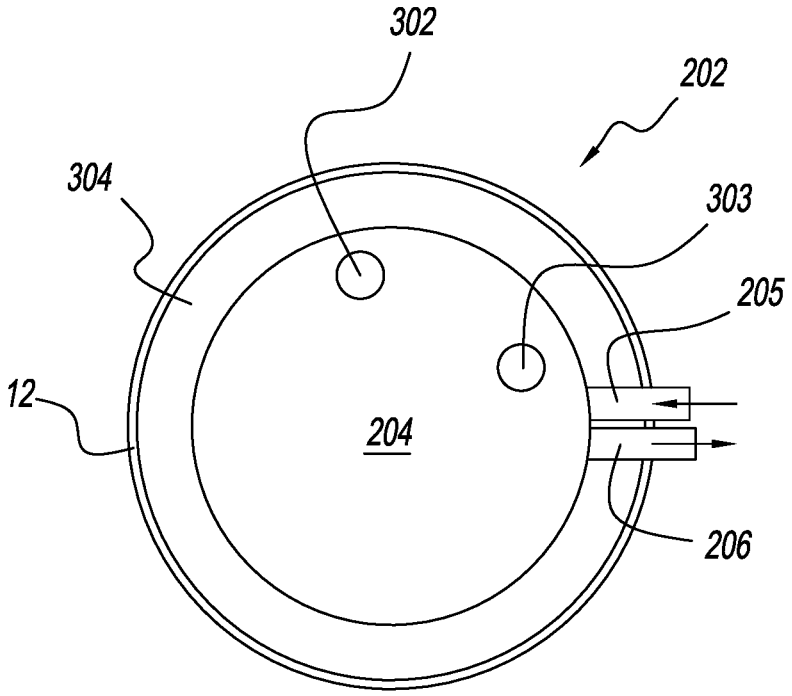
FIG. 9 is a top plan view of the energy recovery chamber of FIGS. 6 and 8 depicting the internal and external connection variations.

FIG. 9 depicts a top plan view of the energy recovery chamber 202 showing the external water connection embodiment and the internal water connection embodiment to the water heat exchanger 204. Particularly, for the external water connection, FIG. 9 shows the water inlet 205 and the water outlet 206. For the internal water connection, FIG. 9 shows the water conduit inlet 302 and the water conduit outlet 303. Annular gap 304 surrounding the water heat exchanger 204 allows the inflowing exhaust gas to outflow into the second flue portion 34.

Figure 10:
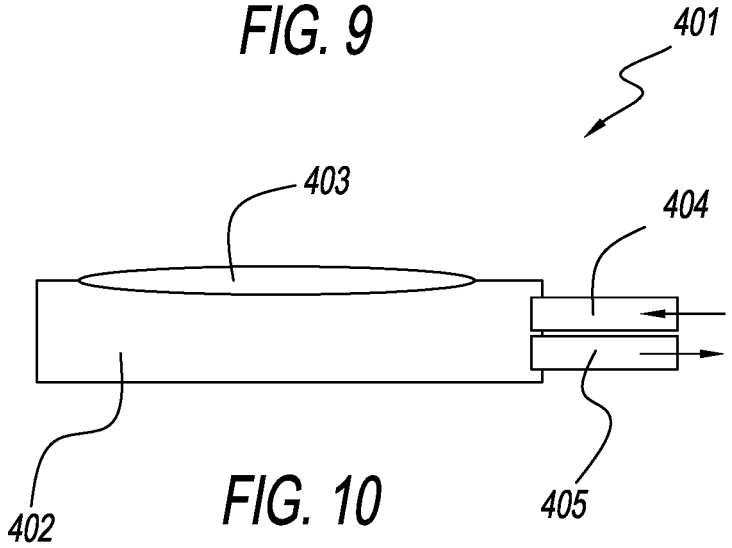
FIG. 10 is an enlarged view of an exhaust diffuser/ring heat exchanger for use in an energy recovery chamber of the present multi-tank storage type gas water heater.

FIG. 10 depicts another type of water heat exchanger 401 for use in the energy recovery chamber 202 of the external water connection embodiment of the multi-stage storage type gas water heater 200, the water heat exchanger 401 being a ring water heat exchanger. The ring water heat exchanger 301 may be in any orientation with one or more chambers consisting of single or multiple water flow paths with variable water flow rate, allowing the ring water heat exchanger 401 to recover more energy from the exhaust gases as they pass around the exhaust diffuser and ring water heat exchanger 401 within the energy recovery chamber 202.

Figure 11:
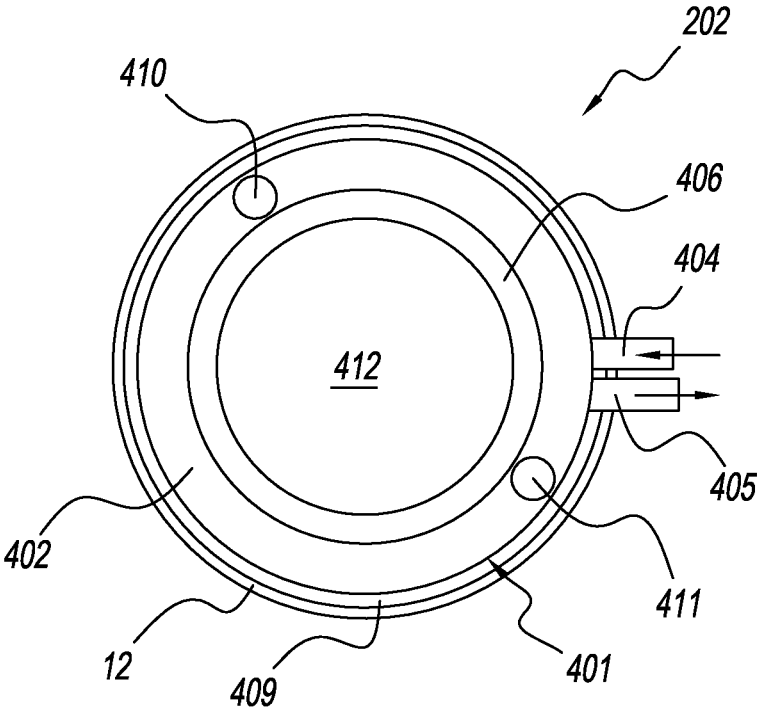
FIG. 11 is a top plan view of an energy recovery chamber of the present multi-tank storage type gas water heater with the exhaust diffuser/ring heat exchanger of FIG. 10 depicting the internal and external connection variations.

FIG. 11 depicts a top plan view of the energy recovery chamber 202 showing the internal water connection embodiment of the ring water heat exchanger 401 for the internal connection embodiment of the multi-tank storage type water heater 300 and an external water connection embodiment of the ring water heat exchanger 401 for the external connection embodiment of the multi-tank storage type gas water heater 200. Particularly, for the external water connection embodiment, FIG. 11 shows the water inlet 404 and the water outlet 405. For the internal water connection embodiment, FIG. 11 shows the water conduit inlet 410 and the water conduit outlet 411. Outer annular gap 409 surrounding the water heat exchanger 401 allows the inflowing exhaust gas to outflow into the second flue portion 34, while inner annular gap 406 radially inward of the water heat exchanger 401 allows the inflowing exhaust gas to also outflow into the second flue portion 34. Shown in FIG. 11 is a diffuser 412 that may be used with the water ring heat exchanger 401.

Figure 12:
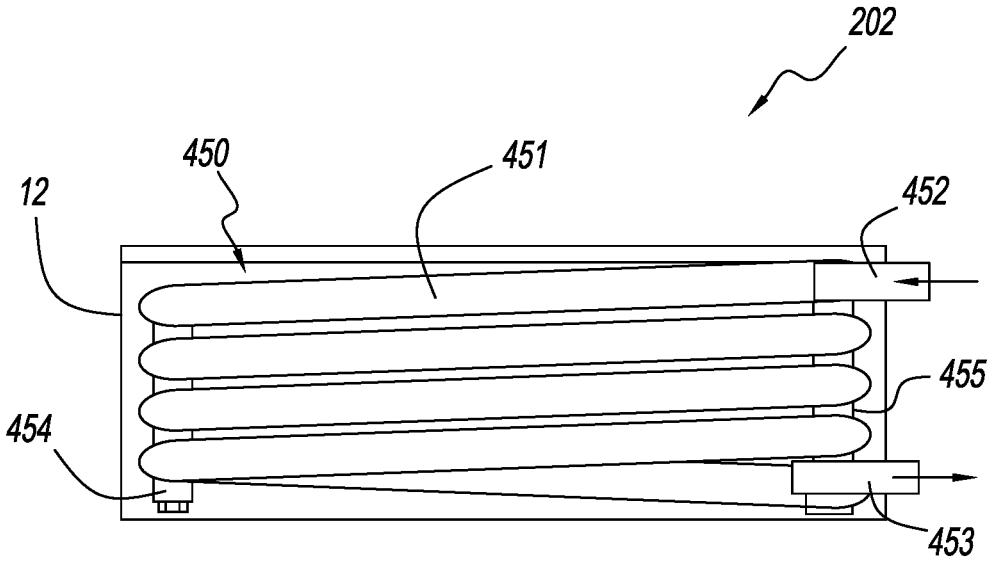
FIG. 12 is an enlarged side view of an internal coil and exhaust directional diffuser for use in an energy recovery chamber of the present multi-tank storage type gas water heater depicting an external connection.
Figure 13:
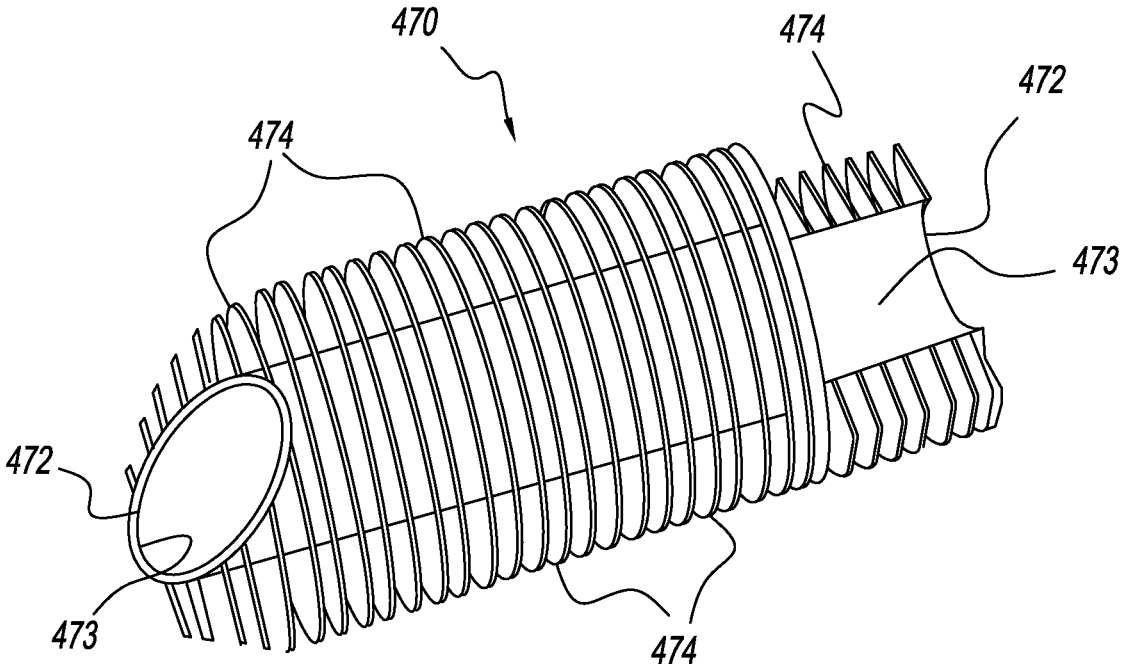
FIG. 13 is an enlarged view of a portion of a finned form of the internal coil of the exhaust diffuser of FIG. 12 with a segment thereof in sectional.

FIG. 12 depicts another type of water heat exchanger 450 for use in the energy recovery chamber 202 of the external water connection embodiment of the multi-stage storage type gas water heater 200, the water heat exchanger 401 being an internal coil water heat exchanger 450. The internal coil water heat exchanger 450 has a coil 451 of tubing with a smooth inner surface and a smooth outer surface. The coil is coupled to a water inlet 452 and a water outlet 453. As shown, the tubing 451 is supported by a first brace 454 and a second brace 455. More or no braces may be provided. In another form of the external coil water heat exchanger 450 as shown in FIG. 13, the coil 470 comprises tubing 472 with a smooth inner surface 473 and a finned outer surface 474.

Figure 14:
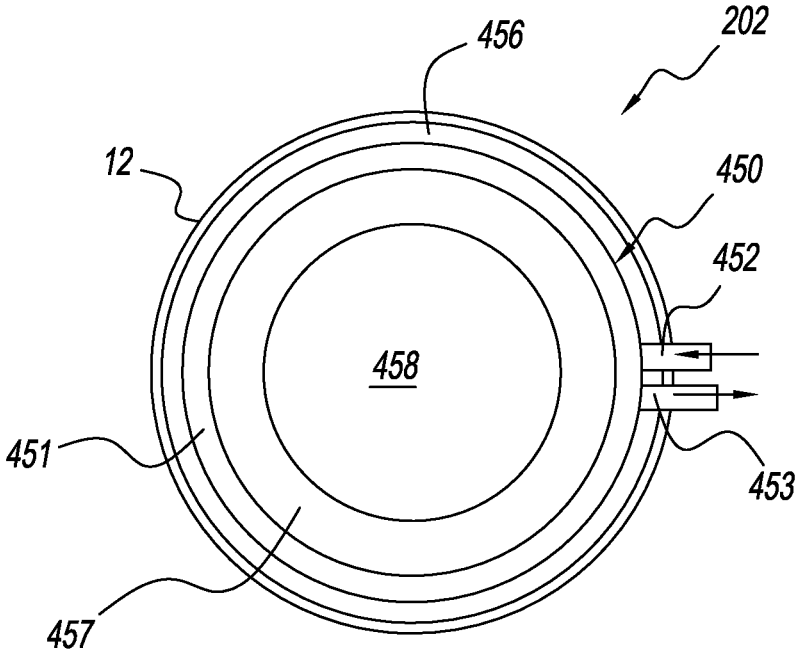
FIG. 14 is a top plan view of the energy recovery chamber with the internal coil and exhaust directional diffuser of FIG. 12 depicting an external connection.

FIG. 14 depicts a top plan view of the energy recovery chamber 202 showing the external water connection embodiment of the internal coil water heat exchanger 450. Outer annular gap 456 surrounding the internal coil water heat exchanger 450 allows the inflowing exhaust gas to outflow into the second flue portion 34, while inner annular gap 457 radially inward of the internal coil water heat exchanger 450 allows the inflowing exhaust gas to also outflow into the second flue portion 34. Shown in FIG. 14 is a diffuser 458 that may be used with the internal coil water ring heat exchanger 450.

Figure 15:
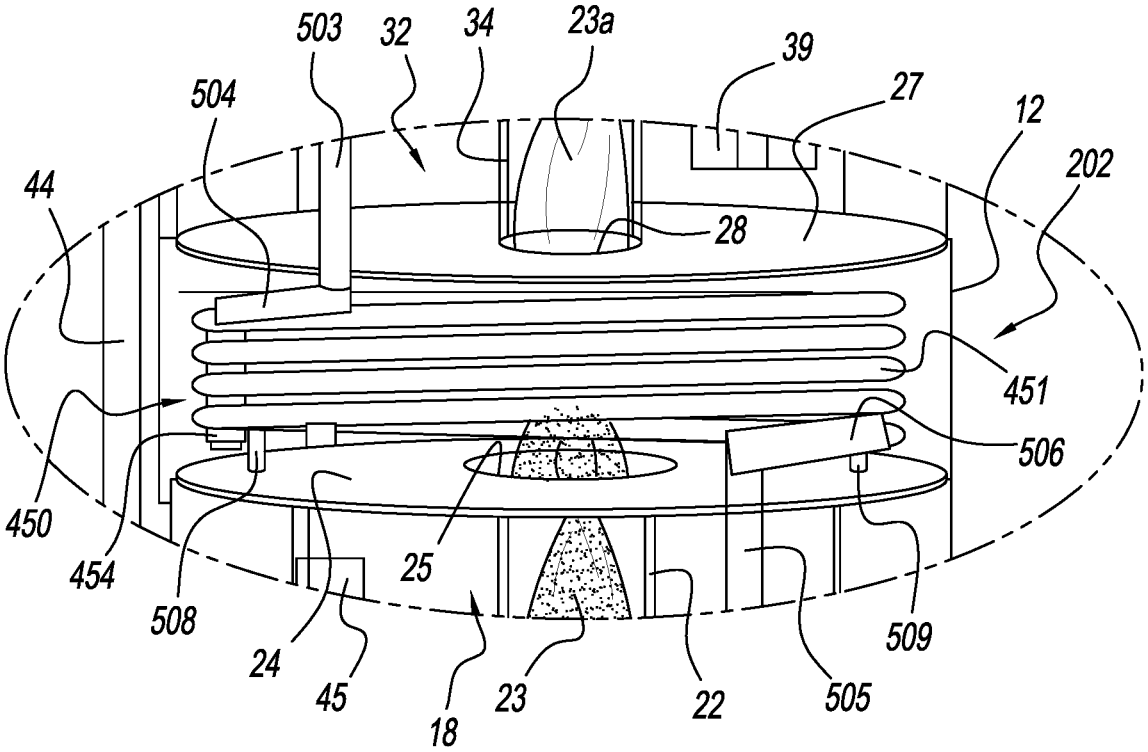
FIG. 15 is an enlarged sectional view of an energy recovery chamber of the present multi-tank storage type gas water heater using the internal coil and exhaust directional diffuser of FIG. 12 depicting an internal connection.

FIG. 15 depicts the energy recovery chamber 202 of an internal water connection embodiment of the internal coil water heat exchanger 450 within the internal water connection embodiment of the multi-stage storage type gas water heater 300. The tubing 451 is coupled to a water inlet 504 that is connected to a water inlet conduit 503 that is in communication with the supplementary water storage tank/area 32 for receiving water from the supplementary water storage tank/area 32. The tubing 451 is coupled to a water outlet 506 that is connected to a water outlet conduit 505 that is in communication with the primary water storage tank/area 18 for providing water to the primary water storage tank/area 18. The tubing 451 is supported in the energy recovery chamber 202 via stands 508 and 509. More or less stands may be used.

Figure 16:
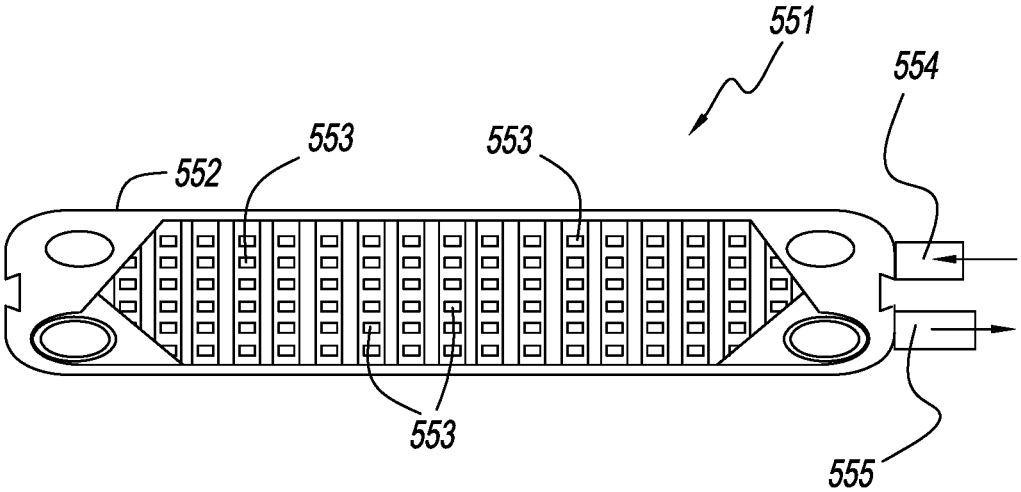
FIG. 16 is an enlarged side view in partial sectional of a finned and tube heat exchanger for use in an energy recovery chamber of the present multi-tank storage type gas water heater.

FIG. 16 depicts another type of water heat exchanger 551 for use in the energy recovery chamber 202 of the external water connection embodiment of the multi-stage storage type gas water heater 200, the water heat exchanger 551 being a finned and tube water heat exchanger 551 providing for a significant amount of surface area for host exhaust gas 23 to flow through. The finned and tube water heat exchanger 551 has a housing 552 that holds a finned tube 553 which winds around the inside of the housing 552. The finned tube 553 is coupled to a water inlet 554 and to a water outlet 555. The finned and tube water heat exchanger 551 can have a round, square, rectangular, box or other shape determined to be the most effective from a cost and assembly perspective. Size is dependent upon size of the energy recovery chamber 202. Material choice follows the same decision criteria in addition to the ability to transfer heat, be durable, have a reasonable cost for materials, and of manufacturing or assembly complexity.

Figure 17:
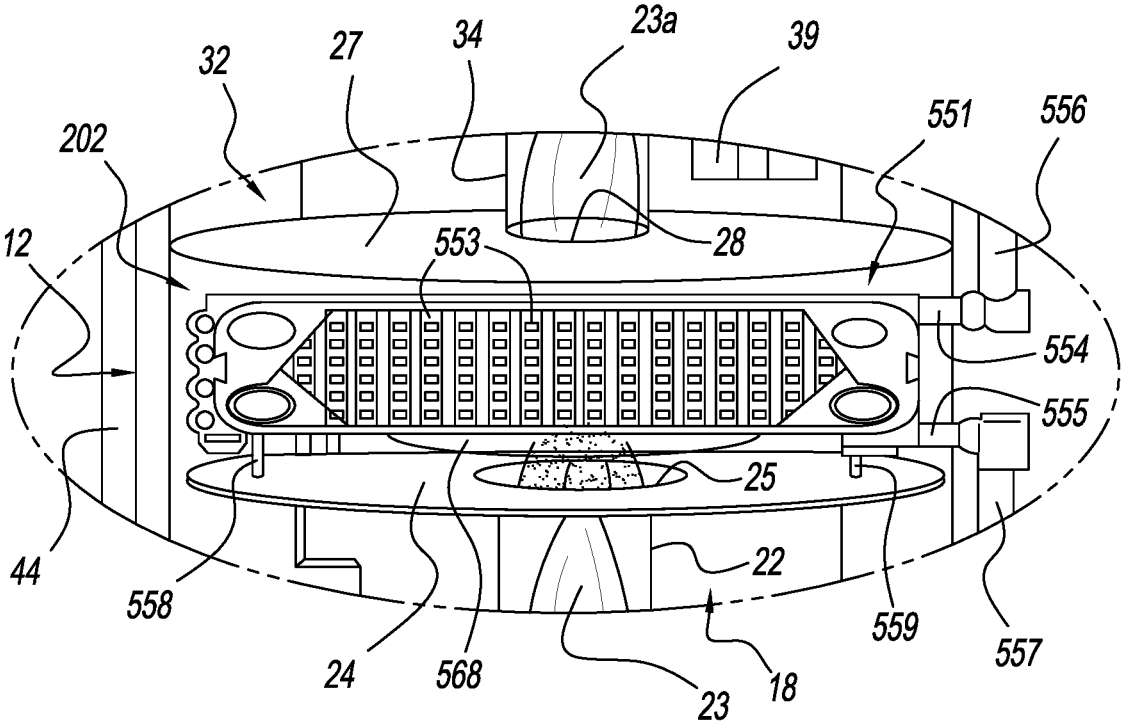
FIG. 17 is an enlarged sectional view of an energy recovery chamber of the present multi-tank storage type gas water heater using the finned and tube heat exchanger of FIG. 16 with a heat diffuser depicting an external connection.

FIG. 17 depicts the energy recovery chamber 202 of an external water connection embodiment of the finned and tube water heat exchanger 551 within the external water connection embodiment of the multi-stage storage type gas water heater 200. The finned and tube water heat exchanger 551 has a water inlet 554 that is coupled to a water inlet conduit 556 that is in communication with the supplementary water storage tank/area 32 for receiving water from the supplementary water storage tank/area 32, and a water outlet 555 that is coupled to a water outlet conduit 557 that is communication with the primary water storage tank/area 18 for supplying water from the finned and tube water heat exchanger 551 to the primary water storage tank/area 18. The finned and tube water heat exchanger 551 is supported in the energy recovery chamber 202 by stands 558 and 559. More or no stands may be used.

Figure 18:
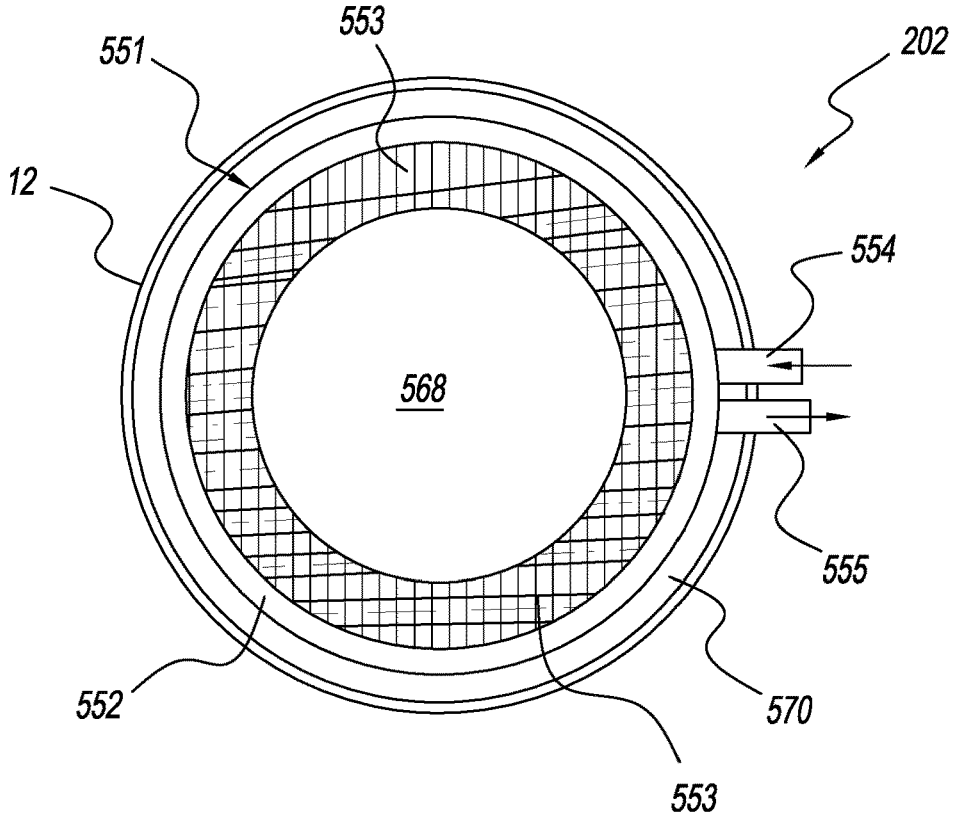
FIG. 18 is a top plan view of the energy recovery chamber of FIG. 17 with the finned and tube heat exchanger depicting an external connection.

FIG. 18 depicts a top plan view of the energy recovery chamber 202 showing the external water connection embodiment of the finned and tube water heat exchanger 551. Outer annular gap 570 surrounding the finned and tube water heat exchanger 551 allows the inflowing exhaust gas to outflow into the second flue portion 34. Shown in FIG. 18 is a diffuser 568 that may be used with the finned and tube water heat exchanger 551.

Figure 20:
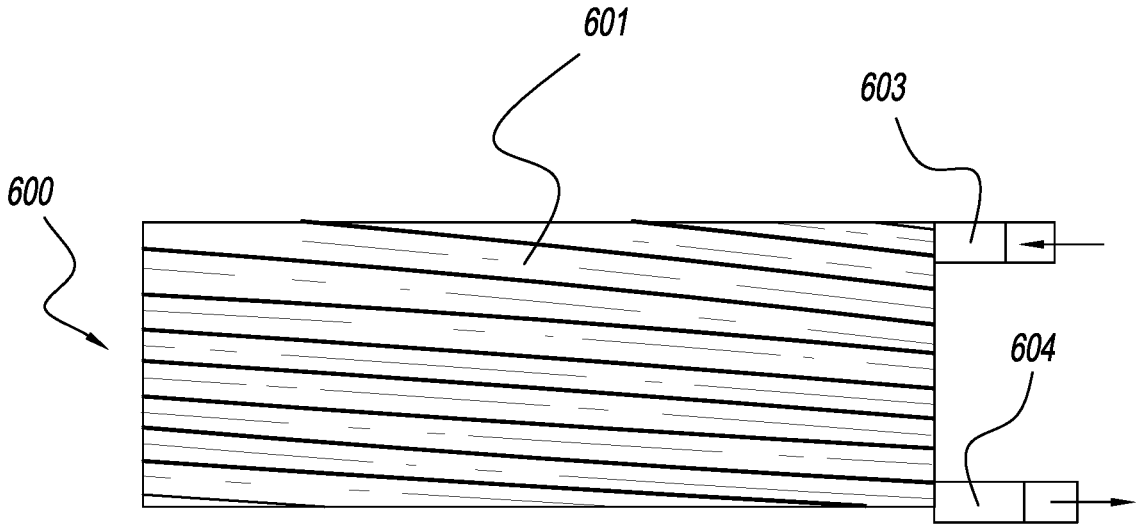
FIG. 20 is an enlarged side view of the external coil heat exchanger of FIG. 19.

FIG. 20 depicts another type of water heat exchanger 600 for use externally of the energy recovery chamber 202 of the external water connection embodiment of the multi-stage storage type gas water heater 200, the water heat exchanger 600 being an external tubular or coil water heat exchanger 600 designed for use outside and around of the energy recovery chamber 202. The external tubular water heat exchanger 600 is comprised of a coil of tubing 601 which is sized to wind around the outside of the energy recovery chamber 202. The external tubular water heat exchanger 600 is coupled to a water inlet 603 and to a water outlet 604. While the external tubular water heat exchanger 600 is shown as a single tube or coil, the size, number of coils, amount of area that is covered of the exterior of the energy recovery chamber 202 would be determined by the size of the energy recovery chamber 202 and what amount of additional efficiency could be extracted using the external tubular water heat exchanger 600. The choice of materials may be determined on a cost basis for heat transfer ability and cost of manufacturing or assembly complexity.

Figure 19:
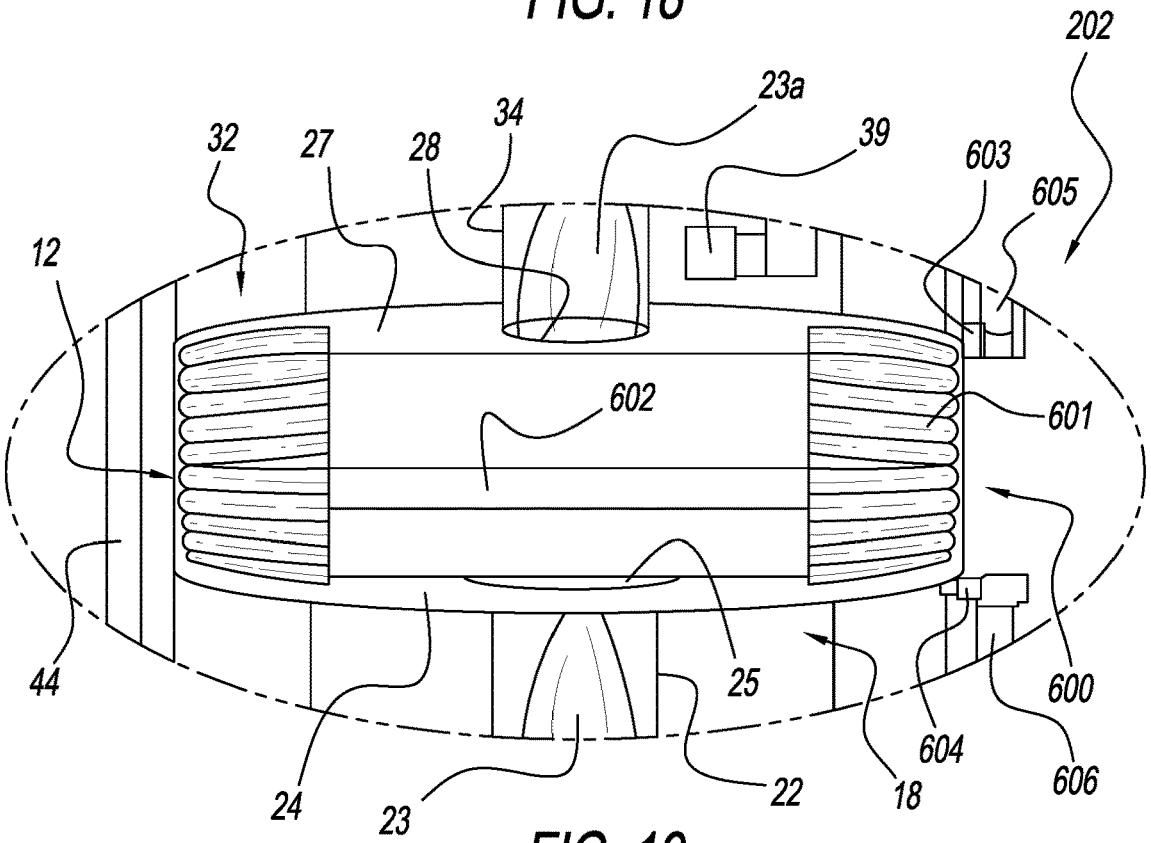
FIG. 19 is an enlarged sectional view of an energy recovery chamber of the present multi-tank storage type gas water heater using an external coil heat exchanger using only an outside of the energy recovery chamber depicting an external connection.

FIG. 19 depicts the energy recovery chamber 202 of the external water connection embodiment of the multi-stage storage type gas water heater 200 with the external tubular water heat exchanger 600. The water inlet 603 of the external tubular water heat exchanger 600 is coupled to a water inlet conduit 605 that is in communication with the supplementary water storage tank/area 32 for receiving water from the supplementary water storage tank/area 32. The water outlet 604 of the external tubular water heat exchanger 600 is coupled to a water outlet conduit 606 that is communication with the primary water storage tank/area 18 for supplying water from the external tubular water heat exchanger 600 to the primary water storage tank/area 18.

Figure 21:
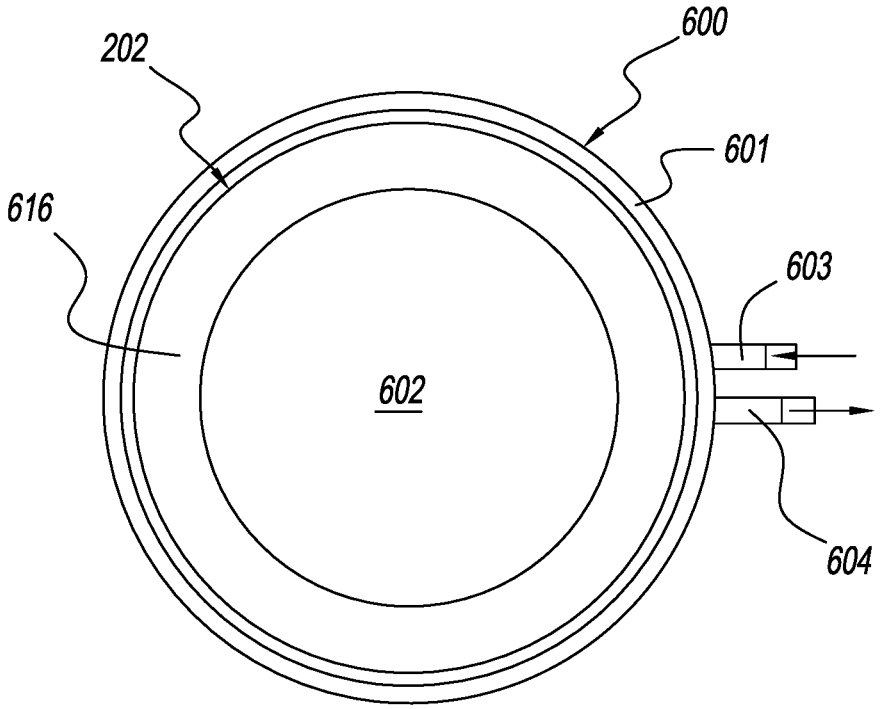
FIG. 21 is a top plan view of the energy recovery chamber of FIG. 19 with a hot gas diffuser.

FIG. 21 depicts a top plan view of the energy recovery chamber 202 showing the external tubular water heat exchanger 600 situated thereabout. A diffuser 602 is shown that may be used with the external tubular water heat exchanger 600. A void 616 in the energy recovery chamber 202 surrounds the diffuser that allows the inflowing exhaust gas to fill the energy recovery chamber to heat the coil 601 of the external tubular water heat exchanger 600 and then outflow into the second flue portion 34.

Figure 22:
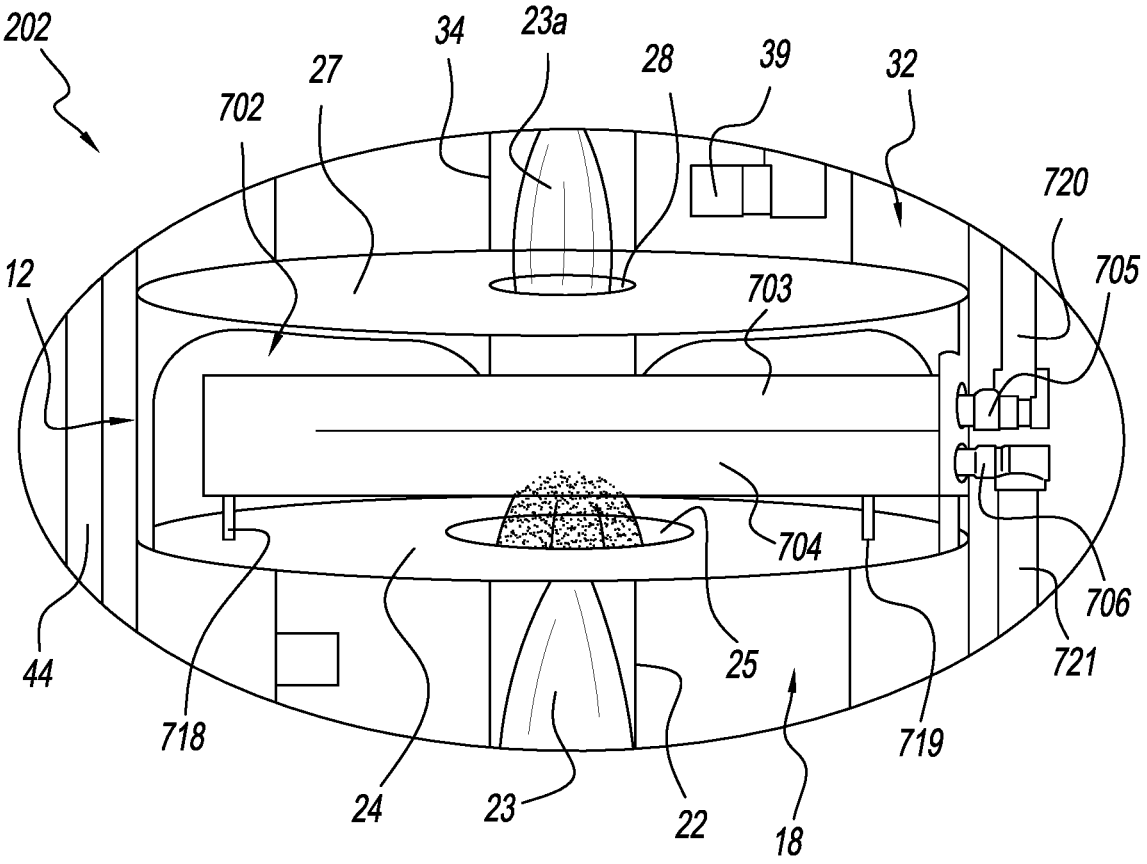
FIG. 22 is an enlarged sectional view of an energy recovery chamber of the present multi-tank storage type gas water heater with a water baffle heat exchanger/diffuser depicting an external connection.

FIG. 22 depicts another type of water heat exchanger 702 for in the energy recovery chamber 202 of the external water connection embodiment of the multi-stage storage type gas water heater 200, the water heat exchanger 702 being a combined diffuser and water baffle 702. The combined diffuser and water baffle 702 has two internal chambers 703, 704 with the chamber 703 connected to a water inlet 705, while the chamber 704 is connected to a water outlet 706. The size and number of the chambers may vary, but may be determined by the size of the energy recovery chamber 202 and what amount of additional efficiency could be extracted thereby. The choice of materials may be determined on a cost basis for heat transfer ability and cost of manufacturing or assembly complexity. The water inlet 705 is coupled to a water conduit 720 that supplies water from the supplementary water storage tank/area 32, while the water outlet 706 is coupled to a water conduit 721 that supplies water from the combined diffuser and water baffle 702 to the primary water storage tank/area 18. While not shown, the combined diffuser and water baffle 702 may be used in the internal water connection embodiment of the multi-stage storage type gas water heater 300.

It should be appreciated that, in the exhaust pipe between each energy recovery chamber there is a metal insert that is attached to the side of the pipe to help air flow directing and help capture and transfer heat from the hot gases to the water-such as is provided in all gas water heater designs manufactured today. If desired, a standard exhaust baffle may be incorporated in the internal exhaust tube between the burner, each energy recovery chamber, and the final exhaust of the present gas water heater.

I should be appreciated that each energy recovery chamber (and most if not all diffuser chambers) is preferably, but not necessarily, an insert between the primary and supplementary tanks (and between any additional supplementary tanks) as a bridging element providing support to the upper tank. The energy recovery chamber or diffuser chamber, consists of a metal ring, a potential heat exchanger—one of multiple types, a diffuser to impinge air flow could either be independent and supported by legs or to sit on top of the bottom tank or supported with support arms attached to outer ring or incorporated in heat exchanger design. These may be welded to make a sealed energy recovery (or diffuser) chamber that connects the adjacent storage tanks. The energy recovery (or diffuser) chamber can be manufactured as a complete unit. if desired, the diffuser and/or water heat exchanger could have support arms extend to the outer edge of the ring to be suspended allowing it to be integrated into that assembly eliminating placement and alignment issues during assembly.

Potential configurations for the energy recovery chamber will preferably, but not necessarily, be driven by balancing cost of materials and complexity of manufacturing against potential efficiency gains. For configurations of the final design, it could be a combination of any of the present designs. There is no limit to the specific materials or shapes and sizes of the present heat extraction concepts. The energy recovery chamber design could be inserted into a two stage (supplementary tanks/areas), three stage (supplementary tanks/areas), or multiple supplementary tanks/areas with each energy recovery chamber and its water heat exchanger being the same or different. All connection points could be internal or external depending on the cost or complexity of manufacturing or the desire for easy servicing. There are no limits on what materials to use or complexity of each type of fixed energy recovery chamber or insert energy chamber that could be applied to achieve the present desired efficiency goals. The energy recovery chamber may be configured to be insertable or a changeable unit, or permanent due to the manufacturing and assembly process. The input and output of water from the various water tanks/areas and/or energy recovery chambers flowing through the potential configurations as shown and/or described herein, could be directed to any water tank/area in a multistage water tank/area configuration. If desired, the flow of this design can be reversed where the hottest water from lower tank is taken and pushed to the upper tank, then flood the cold water into lower tank for heating. While not shown, the present multi-tank gas water heater includes appropriate condensation trap(s) or accommodations for condensation in order that excess condensation may be drained from the water heater.

Regarding recovery time for the present water tank, having a smaller primary tank with same size burner or even possible larger burned combined with tempered water versus cold input water allows for a much faster recovery. The faster recovery accounts for significant opportunity for reducing burner on time and consumption of energy produced by burning of combustible gas. Size of the gas burner can be adjusted to meet performance objective(s) for faster recovery, longer supply capability, lower or higher final exhaust temperatures.

The descriptions and figures presented herein for the various embodiments of the present multi-tank storage type gas water heaters may be considered generalizations attempting to use industry terminology to provide alternative designs to recover via radiation, conduction, convection, or advection energy out of the exhaust gas. As such, the heat exchangers may be in different orientations than shown with one or more chambers consisting of single or multiple tubes for water flow paths with or without variable water flow rate allowing the heat exchanger(s) to recover more energy from the exhaust gas flowing into the energy recovery chamber. The ring water heat exchanger may be in any orientation with one or more chambers consisting of single or multiple chambers for water flow paths. A diffuser may also be used to direct hot exhaust gas around the ring water heat exchanger. Internal tubing or a sealed ring (or other shape) placed inside the energy recovery chamber or unit, with or without external fins, will receive conduction, convection, radiation, and/or advection heat from the exhaust gas. A diffuser may also be used to direct hot exhaust gas flow. External tubing or chambered ring may be placed outside of the energy recovery chamber/unit that would receive heat via conduction, convection, radiation, and/or advection heat from the exhaust gas. Other types of water heat exchangers may be used.

If further supplementary water storage tanks are provided, further diffuser or energy recovery chambers like the diffuser and energy recovery chambers shown and described herein are provided between further adjacent supplementary water storage tanks. Flue portions in like manner to the flue portions shown and described herein are also provided. Piping with appropriate inlet and outlets are also provided to connect and supply temperate water from the further supplementary water storage tanks to previous adjacent supplementary water storage tanks.

It should be appreciated that the size of the various components of the multi-tank storage type gas water heaters 10 and 50, as well as other embodiments thereof, will be dictated by a desired capacity (e.g., in gallons) of the water heater. By having two or more distinct water tanks incorporated in a single water heater system (housing), more energy can be recovered that would normally be lost as common combustion gas exhaust. Having a second or more tank (supplementary tanks) in addition to the primary tank provides for faster recovery of the hot water in the primary water storage tank as the supplementary water storage tank(s) will not be heating the cold water to the final set temperature of the water in the primary water storage tank. While the present multi-tank storage type gas water heater can be the same total capacity as a traditional gas water heater, the two-tank (or more) system will allow for the total BTU/burner capability to be used on a tank with significantly less volume. This, combined with preheated (tempered or temperate) water allows for a faster recovery and longer sustained supply of hot water. When not in use, all standard gas water heaters maintain water at full temperature in standby mode (when hot water is not dispensed). In the present multi-tank storage type gas water heater, the standby volume of the primary water storage tank is less than the standard gas water heater—so it takes less energy to maintain the water hot in the primary water storage tank. While in the standby mode, the present multi-tank storage type gas water heater will continue to maintain the full temperature of the primary water storage tank but will also continue to raise the temperature of the water in the supplementary water storage tank(s). This allows for the supplementary or tempering water storage tank(s) to continually raise the water temperature therein and recapture energy that would normally be lost.

It should be further appreciated that there are no limitations on tanks sizes or number of stages (diffuser or energy recovery chambers and supplementary water storage tanks) that may be used for a specific application to achieve more operational efficiency. The present concept is the same for 3, 4, 5 or more tank configurations. Furthermore, the present multi-tank storage type gas water heater may be configured in a horizontal, vertical, or combination thereof for particular applications. Additionally, while the present multi-tank storage type water heater is shown and described as a gas fired water heater, any type of fuel or energy may be used that produces heated exhaust.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention.

What is claimed is:

1. A storage type gas water heater comprising:

a housing defining a base and a top;

a primary water storage area within the housing;

a gas combustion chamber within the housing and situated vertically below the primary water storage area and above the base;

a gas burner situated in the gas combustion chamber;

a gas inlet in communication with the gas burner for providing gas to the gas burner;

an energy recovery chamber within the housing and situated vertically above the primary water storage area, the energy recovery chamber defined by a lower partition and an upper partition;

a supplementary water storage area within the housing and situated vertically above the upper partition of the energy recovery chamber, the supplementary water storage area having a supplementary water storage area water outlet;

a cold water inlet extending into the housing and in communication with the supplementary water storage area for supplying external cold water to the supplementary water storage area;

a water heat exchanger situated in the energy recovery chamber, the water heat exchanger having a water heat exchanger water outlet, and a water heat exchanger water inlet in communication with the supplementary water storage area water outlet for receiving cold water from the supplementary water storage area, wherein the water heat exchanger comprises a tubular water heat exchanger situated about an external wall of the energy recovery chamber;

a first flue portion extending vertically from the gas combustion chamber, through the primary water storage area, the lower partition of the energy recovery chamber, and into the energy recovery chamber for directing combustion gas from the gas combustion chamber into the energy recovery chamber and allowing the combustion gas to impinge on the water heat exchanger to temperate the cold water in the water heat exchanger received from the supplementary water storage area;

a primary water storage area inlet in communication with the water heat exchanger water outlet for receiving temperate water from the water heat exchanger into the primary water storage area;

a primary water storage area outlet extending from the primary water storage area to outside the housing; and a second gas flue portion extending vertically from the upper partition of the energy recovery chamber vertically above the water heat exchanger, through the supplementary water storage area, and external of the housing;

the gas burner configured to heat the received temperate water from the supplementary water storage area to a preset temperature via the gas burner situated in the gas combustion chamber for outputting heated water from the primary water area and external of the housing via the primary water storage area outlet.

2. A storage type gas water heater comprising:

a housing defining a base and a top;

a primary water storage area within the housing;

a gas combustion chamber within the housing and situated vertically below the primary water storage area and above the base;

a gas burner situated in the gas combustion chamber;

a gas inlet in communication with the gas burner for providing gas to the gas burner;

an energy recovery chamber within the housing and situated vertically above the primary water storage area, the energy recovery chamber defined by a lower partition and an upper partition;

a supplementary water storage area within the housing and situated vertically above the upper partition of the energy recovery chamber, the supplementary water storage area having a supplementary water storage area water outlet;

a cold water inlet extending into the housing and in communication with the supplementary water storage area for supplying external cold water to the supplementary water storage area;

a water heat exchanger situated in the energy recovery chamber, the water heat exchanger having a water heat exchanger water outlet, and a water heat exchanger water inlet in communication with the supplementary water storage area water outlet for receiving cold water from the supplementary water storage area, wherein the water heat exchanger comprises a tubular water heat exchanger situated about an external wall of the energy recovery chamber;

a first flue portion extending vertically from the gas combustion chamber, through the primary water storage area, the lower partition of the energy recovery chamber, and into the energy recovery chamber for directing combustion gas from the gas combustion chamber into the energy recovery chamber and allowing the combustion gas to impinge on the water heat exchanger to temperate the cold water in the water heat exchanger received from the supplementary water storage area;

a primary water storage area inlet in communication with the water heat exchanger water outlet for receiving temperate water from the water heat exchanger into the primary water storage area;

a primary water storage area outlet extending from the primary water storage area to outside the housing; and a second gas flue portion extending vertically from the upper partition of the energy recovery chamber vertically above the water heat exchanger, through the supplementary water storage area, and external of the housing;

the gas burner configured to heat the received temperate water from the supplementary water storage area to a preset temperature via the gas burner situated in the gas combustion chamber for outputting heated water from the primary water area and external of the housing via the primary water storage area outlet;

a second energy recovery chamber within the housing and situated vertically above the supplementary water storage area, the second energy recovery chamber defined by a second lower partition and a second upper partition;

a second water heat exchanger situated in the second energy recovery chamber and vertically above the second flue portion and having a second water heat exchanger water inlet and a second water heat exchanger water outlet;

a second supplementary water storage area situated in the housing vertically above the second energy recovery chamber and having a second supplementary water area inlet and a second supplementary water area outlet;

the second flue portion situated entirely within the housing and extending through the supplementary water storage area and into the second energy recovery chamber for directing combustion gas from the energy recovery chamber into the second energy recovery chamber and allowing the combustion gas to impinge on the second water heat exchanger to heat the second water heat exchanger and temperate the water in the second water heat exchanger;

a third flue portion extending vertically from the second energy recovery chamber vertically above the second water heat exchanger, through the second supplementary water storage area and out the housing;

wherein the cold water inlet is coupled to the second supplementary water storage tank inlet for supplying cold water to the second supplementary water storage tank, the second supplementary water tank outlet is coupled to the second heat exchanger water tank inlet for supplying second temperate water from the second supplementary water storage area to the second water heat exchanger, and the second water heat exchanger water outlet is coupled to the supplementary water storage area water inlet for supplying temperate water from the second water heat exchanger to the supplementary water storage area.

* * * * *